US009316196B2

(12) United States Patent
Nishimura et al.

(10) Patent No.: US 9,316,196 B2
(45) Date of Patent: Apr. 19, 2016

(54) VEHICLE CONTROLLER

(71) Applicant: FUJITSU TEN LIMITED, Kobe-shi, Hyogo (JP)

(72) Inventors: Ryuji Nishimura, Kobe (JP); Akira Takee, Kobe (JP); Shingo Taguchi, Kobe (JP); Takeshi Sakamoto, Kobe (JP); Tetsuya Nomura, Kobe (JP); Satoshi Harumoto, Kobe (JP)

(73) Assignee: FUJITSU TEN LIMITED, Kobe-shi (JP)

( * ) Notice: Subject to any disclaimer, the term of this patent is extended or adjusted under 35 U.S.C. 154(b) by 265 days.

(21) Appl. No.: 13/827,018

(22) Filed: Mar. 14, 2013

(65) Prior Publication Data

US 2013/0261941 A1 Oct. 3, 2013

(30) Foreign Application Priority Data

Mar. 29, 2012 (JP) ..... 2012-075542

(51) Int. Cl.
*F02N 11/08* (2006.01)
*G07C 9/00* (2006.01)

(52) U.S. Cl.
CPC ..... *F02N 11/0807* (2013.01); *G07C 9/00896* (2013.01); *F02N 2300/306* (2013.01)

(58) Field of Classification Search
CPC ..... F02N 11/08; F02N 2300/306; G07C 9/00896
USPC ..... 701/113, 2; 123/179.2, 179.3; 340/5.61, 340/426.13, 426.36, 902, 425.5, 539.1
See application file for complete search history.

(56) References Cited

U.S. PATENT DOCUMENTS

2005/0134480 A1* 6/2005 Nath et al. ..... 340/902
2007/0257769 A1* 11/2007 Matsubara et al. ..... 340/5.61
2008/0129473 A1* 6/2008 Tsuruta et al. ..... 340/426.13

(Continued)

FOREIGN PATENT DOCUMENTS

CN 1226012 A 8/1999
JP 2005-207110 A 8/2005

(Continued)

OTHER PUBLICATIONS

Mar. 30, 2015 Office Action issued in Chinese Application No. 201310019521.7.

(Continued)

*Primary Examiner* — Stephen K Cronin
*Assistant Examiner* — Xiao Mo
(74) *Attorney, Agent, or Firm* — Oliff PLC

(57) ABSTRACT

A vehicle controller is installed in a vehicle and controls one or more operations of the vehicle. The vehicle controller includes a control unit that: (i) outputs a first code for authentication to a judging apparatus which judges whether to permit starting of a driving apparatus of the vehicle when a request for starting the driving apparatus is obtained from an information processor which is located outside the vehicle, (ii) controls locking and unlocking of doors of the vehicle when a request for door lock control is obtained from the information processor, and (iii) obtains from the judging apparatus an authentication result of whether the first code and a second code for authentication which the judging apparatus uses are identical. When obtaining the request for door lock control, the control unit controls the locking and unlocking of the doors based on the authentication result.

8 Claims, 25 Drawing Sheets

(56) References Cited

U.S. PATENT DOCUMENTS

2011/0202200 A1* 8/2011 Koike ..... 701/2
2012/0323407 A1* 12/2012 Koike ..... 701/2

FOREIGN PATENT DOCUMENTS

JP A-2006-352460 12/2006
JP 2007-146396 A 6/2007
JP 2008-001132 A 1/2008
WO WO 2011102369 A1 * 8/2011

OTHER PUBLICATIONS

Jan. 6, 2016 Office Action issued in Japanese Patent Application No. 2012-075542.

* cited by examiner

PROCESSING FOR REGISTERING IMMOBILIZER

PROCESSING FOR TRANSMITTING VEHICLE POSITION INFORMATION

PROCESSING FOR STARTING & PROCESSING FOR DOOR LOCK

PROCESSING FOR STARTING (STEP S 806)

PROCESSING ON VEHICLE CONTROLLER

VEHICLE CONTROLLER

BACKGROUND OF THE INVENTION

1. Field of the Invention

The invention relates to a technology that controls a vehicle by use of a mobile terminal.

2. Description of the Background Art

Conventionally known are a remote starter that controls starting of a driving apparatus such as an engine or a motor of user's vehicle, and a remote door lock system that controls locking and unlocking of doors of user's vehicle, by use of a mobile terminal. By use of these technologies, a user can start the driving apparatus or can lock or unlock the doors, of user's vehicle that is away from the user. Therefore, in an example, the user can turn on an air conditioner to control the temperature of the vehicle cabin to be appropriate before the user gets in user's vehicle. In another example, the user can open or close the doors of user's vehicle without inserting a key in the vehicle. Known these days is a remote operation system that operates an in-vehicle apparatus of user's vehicle via a center by use of a mobile phone as the mobile terminal.

In the case where a vehicle is controlled by a remote controller such as the remote starter or the remote door lock system, the in-vehicle apparatus to be controlled and user's remote controller are associated so that the user does not control another in-vehicle apparatus wrongly. In the case of a remote operation system that operates user's in-vehicle apparatus through the center by use of the mobile phone, the mobile phone and the in-vehicle apparatus are associated.

However, in the case where the mobile phone and the in-vehicle apparatus are associated, a stranger can operate user's vehicle from a distance when the stranger's in-vehicle apparatus is insidiously installed in the proper user's vehicle. In this case, the items in the vehicle or the vehicle itself are in danger of being stolen.

SUMMARY OF THE INVENTION

According to one aspect of the invention, a vehicle controller is installed in a vehicle and controls one or more operations of the vehicle. The vehicle controller includes a control unit that: (i) outputs a first code for authentication to a judging apparatus which judges whether to permit starting of a driving apparatus of the vehicle when a request for starting the driving apparatus is obtained from an information processor which is located outside the vehicle, (ii) controls locking and unlocking of doors of the vehicle when a request for door lock control is obtained from the information processor, and (iii) obtains from the judging apparatus an authentication result of whether the first code and a second code for authentication which the judging apparatus uses are identical. When obtaining the request for door lock control, the control unit controls the locking and unlocking of the doors based on the authentication result.

Since the control unit controls the locking and unlocking of the doors based on the authentication result of whether the first code for authentication which the vehicle controller uses and the second code which the judging apparatus uses are identical, the control unit is capable of changing the control of locking and unlocking of the doors depending on whether the vehicle controller belongs to the proper user.

According to another aspect of the invention, when the authentication result indicates that the first code and the second code are not identical, the control unit prohibits execution of the request for door lock control.

When the vehicle controller does not belong to the proper user, the control unit is capable of prohibiting the execution of the request for door lock control.

Therefore, the object of the invention is to provide a technology relevant to vehicle control that is capable of making judgment on whether a vehicle controller that controls a vehicle belongs to a proper user, and of changing permission of the vehicle control based on a result of the judgment.

These and other objects, features, aspects and advantages of the present invention will become more apparent from the following detailed description of the present invention when taken in conjunction with the accompanying drawings.

DESCRIPTION OF THE EMBODIMENTS

Hereinafter, some embodiments of the invention are described with reference to attached drawings.

<1. First Embodiment>

<1-1. Outline of System>

Figure 1:
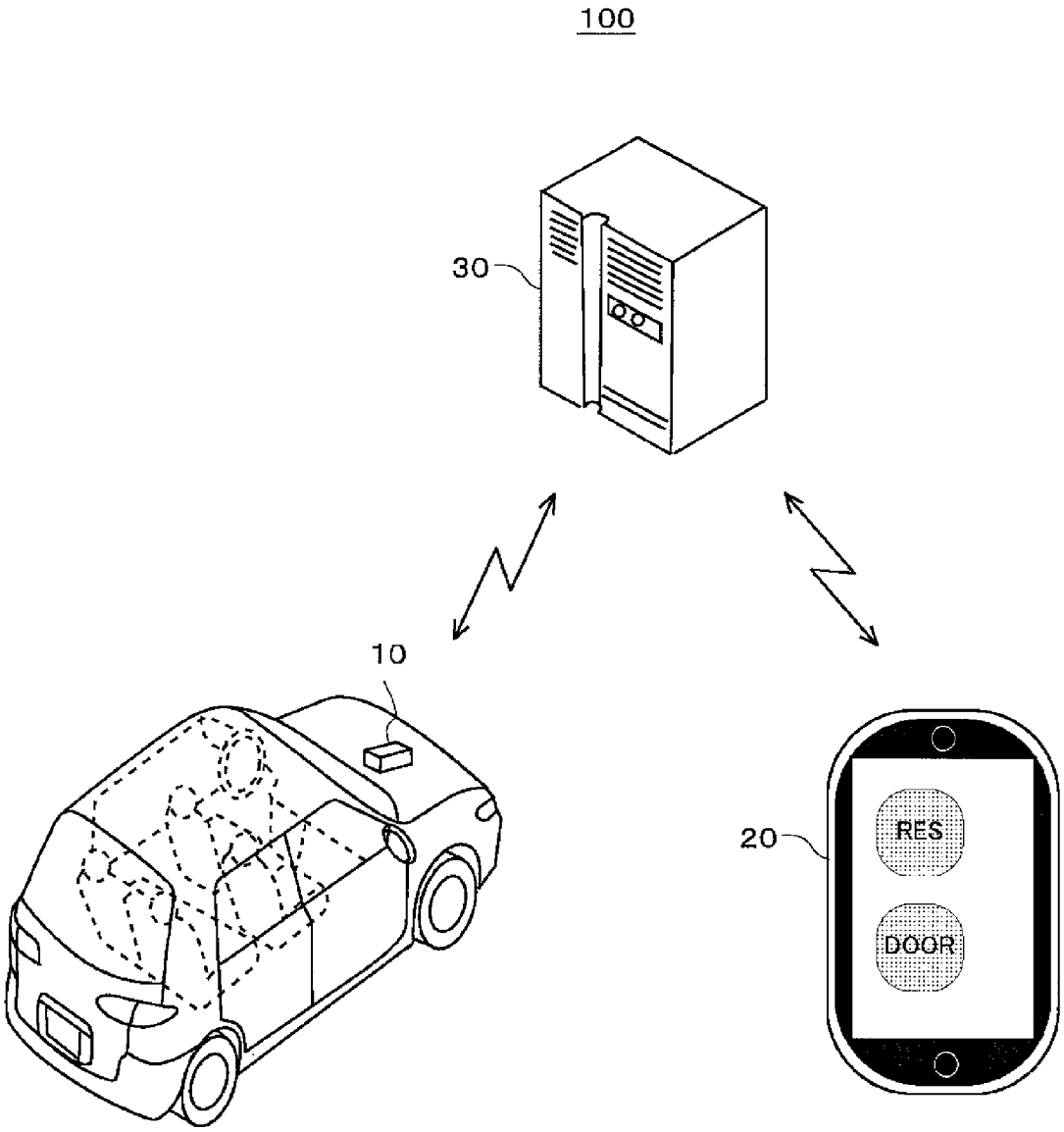
FIG. 1 shows an outline of a vehicle control system.

FIG. 1 shows an outline of a vehicle control system 100 of the embodiment. The vehicle control system 100 includes a vehicle controller 10, a mobile terminal 20 and a center 30.

The vehicle controller 10 is installed in a vehicle to control the vehicle in accordance with the control information transmitted by the center 30. The vehicle controller 10 that is coupled with the center 30 so as to communicate with each other receives via the center 30 from the mobile terminal 20 the control information such as a request for starting or a request for door lock control, and transmits to the center 30 a result of the control. In an example, upon receiving the request for starting from the center 30, the vehicle controller 10 controls the starting of the driving apparatus of the vehicle or various apparatuses. Or, upon receiving the request for door lock control, the vehicle controller 10 controls locking of the doors of the vehicle.

In the invention, the vehicle is equipped with a so-called immobilizer. Upon receiving the request for starting from the center 30, the immobilizer gives authentication, and the vehicle controller 10 obtains a result of the authentication. When the request for starting is proper, the vehicle controller 10 controls the starting of the driving apparatus. When receiving the request for door lock control, the vehicle controller 10 controls door lock based on the immobilizer authentication result.

Here, the door lock control includes both of the controls for locking and unlocking the doors of a vehicle. The driving apparatus is an engine or a motor. Each of the engine and the motor can be used in the invention. However, for convenience sake, some embodiments may be described by use of the engine. The various apparatuses are, for example, an air conditioner. That is, for example in the starting control, starting/stop of the engine or the motor, on/off operation of the air conditioner are controlled. Hereafter, "door lock" may be used for collective indication of locking doors and unlocking doors. Or, "driving apparatus" may be used collectively as the targets to be remotely started, and "starting" may be used for collective indication of the actions such as start/stop and on/off operation.

The mobile terminal 20 is a mobile electronic device carried by a user, for example, a smartphone, a tablet PC, a mobile phone or a PDA (Personal Digital Assistant). The mobile terminal 20 stores an application for operating a vehicle from a distance. Here, as the examples of the application, there are the application for locking and unlocking doors of a vehicle from a distance, and the application for starting a driving apparatus from a distance. The user can remotely make various settings or send the request for door lock control or for starting, by executing the application stored in the mobile terminal 20. The mobile terminal 20 is configured to be communicatively coupled to the center 30, and transmits to the center 30 the requests for door lock and for starting, the information on various settings and the position information of the mobile terminal 20.

The center 30 is an information processor that totally controls the vehicle control system 100. The center 30 is configured to be communicatively coupled to the vehicle controller 10 and to the mobile terminal 20, and controls door lock or door unlock, and starting or stop of the driving apparatus, by transmitting and receiving the request for door lock control and the request for starting with each other. Concretely, upon receiving the request for door lock control from the mobile terminal 20, the center 30 makes control such as for transmitting the request for door lock control to the vehicle controller 10. In another concrete example, the center 30 receives from the vehicle the vehicle information including the position information, and also receives from the mobile terminal 20 the request for starting and the position information. Upon receiving the request for starting from the mobile terminal, the center 30 makes control, such as judgment or direction on whether to implement starting, based on the position information of the mobile terminal 20 and the position information of the vehicle.

The vehicle control system 100 of the embodiment is capable of controlling a vehicle only when the vehicle controller 10 is proper in terms of the door lock control conducted based on the immobilizer authentication result when the vehicle controller 10 receives the request for door lock control from the center 30. Detailed hereafter are the configuration of and the processing on the vehicle control system 100.

<1-2. Configuration of Vehicle Controller>

Figure 2:
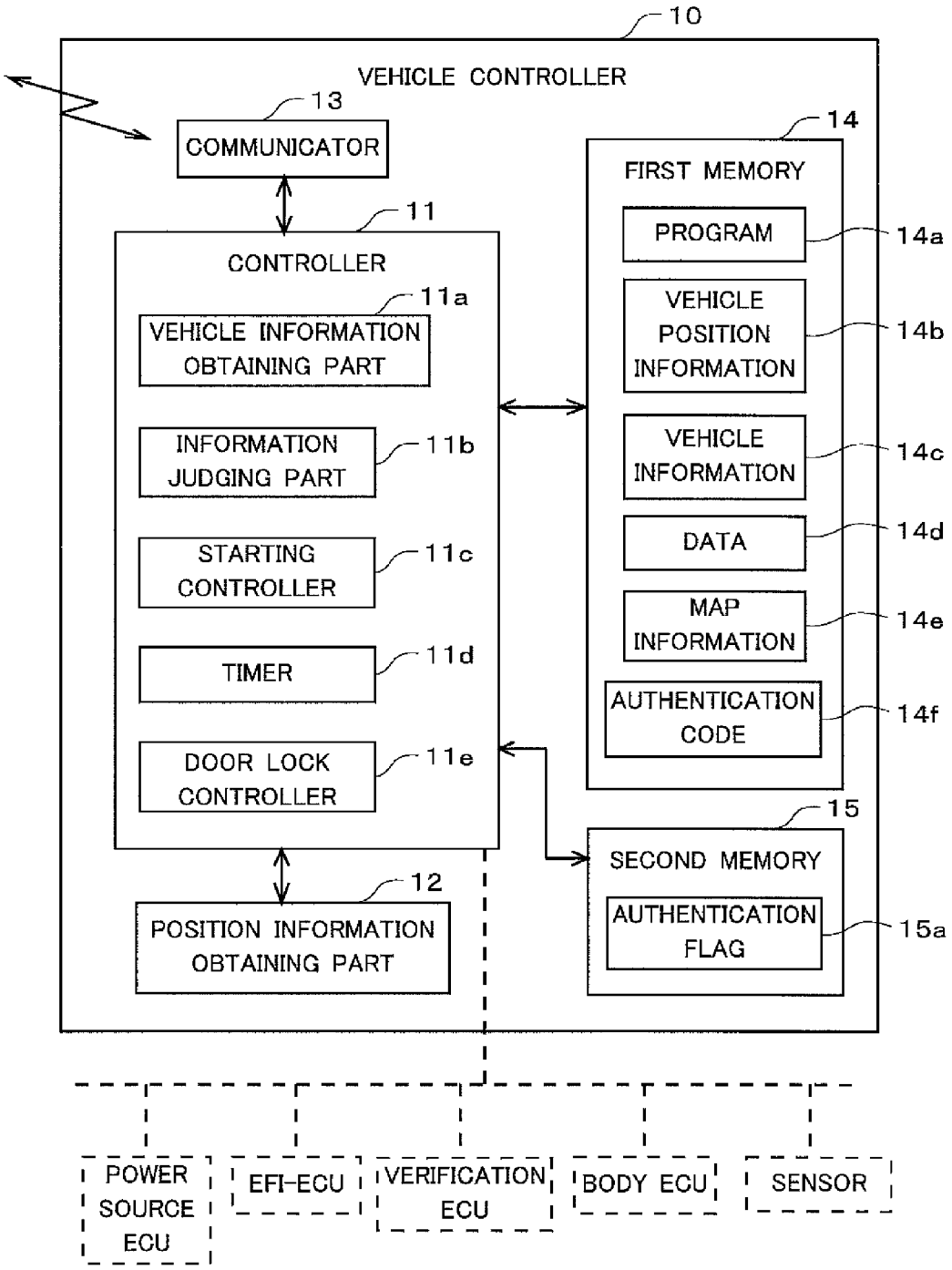
FIG. 2 shows a schematic block diagram of a vehicle controller.

First, the configuration of the vehicle controller 10 is described. FIG. 2 shows a schematic block diagram of the vehicle controller 10. As shown in FIG. 2, the vehicle controller 10 includes a controller 11 (that may be referred to as a control unit), a position information obtaining part 12, a communicator 13, a first memory 14 and a second memory 15.

The controller 11 that includes a vehicle information obtaining part 11*a*, an information judging part 11*b*, a starting controller 11*c*, a timer 11*d* and a door lock controller 11*e*, is a computer that has a CPU, RAM and ROM not shown in FIG. 2. The controller 11 that is connected to the communicator 13 and the first memory 14 included in the vehicle controller 10, controls the whole of the vehicle controller 10 by transmitting and receiving information based on a program 14*a* stored in the first memory 14. Arithmetic processing executed by the CPU based on the program stored in the first memory 14 provides the functions of the controller 11, such as of the starting controller 11*c* and the door lock controller 11*e*. Since the controller 11 controls the overall processing on the vehicle controller 10, the controller 11 also controls the processing other than the processing executed by the vehicle information obtaining part 11*a*, the information judging part 11*b*, the starting controller 11*c*, the timer 11*d* and the door lock controller 11*e* described above.

The controller 11 is communicatively coupled to other various sensors and ECUs (Electronic Control Units) installed in the vehicle via an on-vehicle LAN (Local Area Network) such as a CAN (Controller Area Network) for transmitting and receiving various types of information. The sensors coupled to the controller 11 are, for example, a vehicle velocity sensor and a steering angle sensor that detect the vehicle driving conditions. The ECUs coupled to the controller 11 are, for example, EFI-ECU (Electric Fuel Injection-ECU) that controls fuel injection and a body ECU that controls door lock and door unlock. Besides, the ECUs include a verification ECU that controls the processing for authentication with the immobilizer installed in the vehicle and a power source ECU that supplies power to the respective ECUs installed in the vehicle.

The vehicle information obtaining part 11*a* obtains the vehicle information as the information indicating the driving conditions of the vehicle and the conditions of other ECUs. That is, the vehicle information obtaining part 11*a* obtains the vehicle information that is the output of these sensors and ECUs through the CAN.

The information judging part 11*b* judges the contents of the vehicle information obtained from other sensors and the ECUs in the vehicle, and judges the contents of the information received from the center 30. Besides the information described above, the vehicle information includes the information on the ignition switch being switched on or off. The information received from the center 30 includes a command relevant to the request for door lock control or the request for starting the driving apparatus.

The starting controller 11*c* controls the starting or the stop of the driving apparatus and various apparatuses that are installed in the vehicle. That is, the starting controller 11*c* transmits an applicable direction to the ECU to be controlled upon receiving the command of the request for starting from the center 30. In the configuration of the embodiment, the vehicle includes the immobilizer, and the starting controller 11*c* changes whether to transmit the direction for starting depending on the result of the authentication with the immobilizer.

Concretely, upon receiving the command of the request for starting, the starting controller 11*c* reads out an authentication code 14*f* stored in the first memory 14, and transmits the authentication code 14*f* to the verification ECU. The verification ECU has the authentication code of the side of the immobilizer, and executes the processing such as for comparing the authentication code with the authentication code transmitted by the starting controller 11*c* and for giving authentication when the two of the authentication codes are identical (hereinafter, referred to as "immobilizer authentication"). The verification ECU transmits the result of the immobilizer authentication to the starting controller 11*c*, and transmits the starting permission signal to the EFI-ECU when the two of the authentication codes are identical. That is, the verification ECU has a function as a judging apparatus that judges whether to permit the starting of the driving apparatus. When the two of the authentication codes are identical, the starting controller 11*c* transmits the direction for starting to the ECU that controls the driving of the driving apparatus.

Further, upon receiving the authentication result from the verification ECU, the starting controller 11*c* stores the flag indicating the authentication result (hereinafter, referred to as "authentication flag") in the second memory 15. Concretely, when the two of the authentication codes are identical, the starting controller 11*c* sets the authentication flag. When the two of the authentication codes are not identical, the starting controller 11*c* deletes the authentication flag.

The timer 11*d* measures elapsed time. In an example, when the period of time for driving the driving apparatus by use of the remote starting function is determined in advance, the timer 11*d* measures the elapsed time from the starting, and judges whether the predetermined period of time has elapsed. The timer 11*d* is also capable of measuring clock time, for example, measuring the clock time at the time of the starting.

The door lock controller 11*e* controls the door lock and the door unlock of the vehicle. That is, the door lock controller 11*e* transmits an applicable direction to the body ECU upon receiving the command of the request for door lock control from the center 30. In an example, upon receiving the command of the request for door unlock from the center 30, the door lock controller 11*e* transmits via the CAN the direction for door unlock to the body ECU.

In the embodiment, the door lock controller 11*e* changes whether to transmit the direction for door lock depending on whether the vehicle controller 10 belongs to the proper user. Concretely, when the authentication flag is set in the second memory 15, it is judged that the vehicle controller 10 belongs to the proper user and the transmission of the direction for door lock is permitted. When the authentication flag is deleted, it is judged that the vehicle controller 10 does not belong to the proper user and the transmission of the direction for door lock is prohibited.

The position information obtaining part 12 obtains the position information indicating the current position of the vehicle controller 10. For example, GPS (Global Positioning System), may be used as the position information obtaining part 12. The position information includes latitude information and longitude information. That is, the position information obtaining part 12 obtains the latitude information and the longitude information of the current position by use of the GPS.

In some environments where the vehicle controller 10 is installed, the position information is not available through the GPS. In this case, the position information obtaining part 12 obtains the information indicating that the position information is undetermined (hereinafter, referred to as "undetermined-information") as the information indicating that the position information is not available.

The position information also indicates the position of the vehicle because the obtained position information indicates the position of the vehicle controller 10 that is installed in the vehicle. Therefore, the position information obtained by the position information obtaining part 12 is referred to as "vehicle position information" hereafter. That is, the vehicle position information includes the position information including the latitude information and the longitude information obtained by the GPS, and the undetermined-information when the position information is not available through the GPS. The vehicle position information 14*b* is stored in the first memory 14.

The communicator 13 is communicatively coupled to the center 30 for transmitting information to and receiving information from the center 30. In an example, the communicator 13 transmits the vehicle position information and the vehicle information to the center 30, and receives from the center 30 the command such as of the request for door lock control or the request for starting, that is, the control information. Communication between the vehicle controller 10 and the center 30 is through a so-called mobile telephone network. Therefore, the communicator 13 also judges whether the communicator 13 is located in "service area" where the communication with the center is available, or in "out-of-service area" where the communication is not available. The data such as the command transmitted by the center 30 are stored in the first memory 14.

The first memory 14 stores the program 14*a*, the vehicle position information 14*b*, vehicle information 14*c*, data 14*d*, map information 14*e* and the authentication code 14*f*. The first memory 14 of the embodiment is nonvolatile semiconductor memory where reading and writing data are electrically available and that is capable of keeping data even in a power-off state. For example, EEPROM (Electrical Erasable Programmable Read-Only Memory) or a flash memory may be used as the first memory 14. However, other memory media or a hard disk drive including a magnetic disk may be also used. The program is so-called system software that the controller 11 reads out to execute for controlling the vehicle controller 10. The data 14*d* are, for example, various data received from the center 30. The map information 14*e* includes road information and facility information around the country or in a predetermined wide area.

The second memory 15 stores an authentication flag 15*a* indicating the result of the immobilizer authentication. The second memory 15 of the embodiment is volatile semiconductor memory where reading and writing data are electrically available and where the data are deleted when power is disconnected. For example, RAM may be used as the second memory 15. In the second memory 15, since power is kept supplied from the backup battery installed in the vehicle, the authentication flag 15*a* is not deleted even when power supply from a battery is stopped by the ignition switch being turned off. However, when the vehicle controller 10 itself is taken off from the vehicle, the authentication flag 15*a* is deleted.

<1-3. Configuration of Mobile Terminal>

Figure 3:
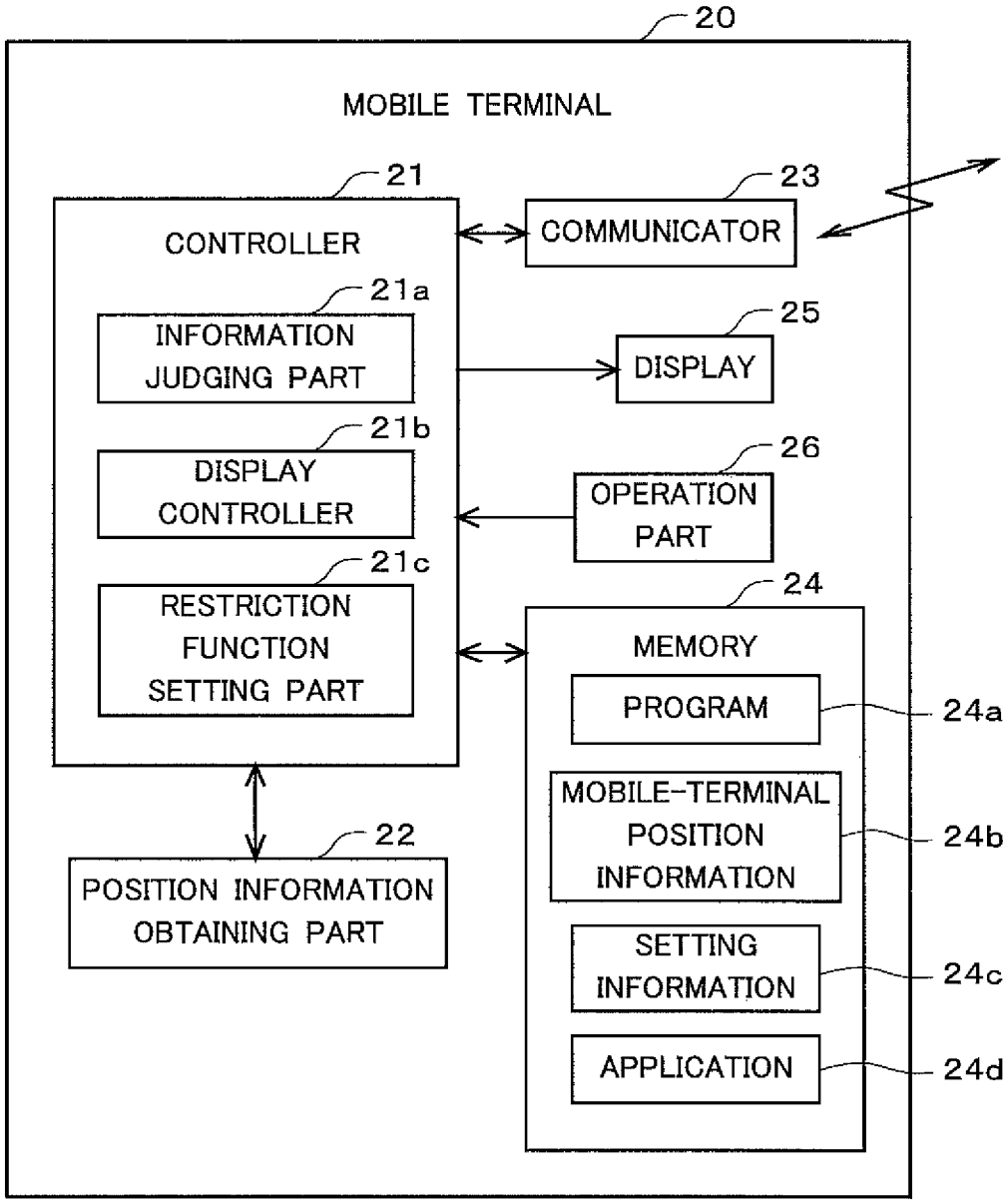
FIG. 3 shows a schematic block diagram of a mobile terminal.

Described next is the configuration of the mobile terminal 20. FIG. 3 shows a schematic block diagram of the mobile terminal 20. As shown in FIG. 3, the mobile terminal 20 includes a controller 21, a position information obtaining part 22, a communicator 23, a memory 24, a display 25 and an operation part 26.

The controller 21 that includes an information judging part 21*a*, a display controller 21*b* and a restriction function setting part 21*c*, is a computer that has a CPU, RAM and ROM not shown in FIG. 3. The controller 21 that is connected to the communicator 23, the memory 24, and others included in the mobile terminal 20, transmits and receives information based on a program 24*a* stored in the memory 24, and controls the whole of the mobile terminal 20. Arithmetic processing executed by the CPU based on the program stored in the memory 24 provides the functions of the controller 21 such as of the information judging part 21*a* and the display controller 21*b*. Since the controller 21 controls the overall processing on the mobile terminal 20, the controller 21 controls the processing other than the processing executed by the information judging part 21*a*, the display controller 21*b* and the restriction function setting part 21*c*, besides the processing for executing the functions of the applications relevant to door lock and remote starting.

The information judging part 21*a* judges the contents of the obtained information. In an example, the information judging part 21*a* judges the contents of the information received from the center 30, and judges the contents of the commands entered via the operation part 26 of the mobile terminal 20. The information received from the center 30 includes, for example, an inquiry relevant to the vehicle information and an inquiry on whether to implement the starting. The command entered via the operation part 26 of the mobile terminal 20 includes, for example, the command of the request for door lock control and the command of the request for starting the driving apparatus.

The display controller 21*b* makes control so as to display an image on the display 25 of the mobile terminal 20. Concretely, the display controller 21*b* makes control to display on the display 25 a screen such as an operation screen that accepts a direction for door lock and a direction for starting the driving apparatus, or a check screen received from the center 30.

The restriction function setting part 21*c* activates or deactivates the function that restricts the processing for the remote starting of the driving apparatus of the vehicle (hereinafter, referred to as "restriction function") when predetermined conditions are met. The predetermined conditions are the conditions that determine whether to execute the function for the remote starting of the driving apparatus of the vehicle (hereinafter, referred to as "restriction conditions"). The restriction function setting part 21*c* also has a function to change the restriction conditions. One of the restriction conditions relates to the distance between the position of the mobile terminal 20 at the time of the request for starting and the vehicle position at the time of parking start. The restriction function based on this restriction condition is indicated as "distance-restriction function."

The information indicating the restriction function activated or deactivated and the restriction conditions (hereinafter, referred to as "setting information" collectively) are stored in the memory 24. When the user selects a setting mode by operating the mobile terminal, setting information 24*c* is read out from the memory 24 and displayed on the display 25. The user can set new setting information in terms of the displayed setting information by activating or deactivating the restriction function, or by changing the conditions in accordance with a change screen. The new setting information is transmitted to the center 30 as well as being stored in the memory 24. The setting information 24*c* may not be stored in the memory 24 of the mobile terminal 20, but be stored only in a memory 33 of the center 30. In this case, the restriction function setting part 21*c* reads out the setting information from the memory 33 of the center 30.

The position information obtaining part 22 obtains the position information indicating the current position of the mobile terminal 20 (hereinafter, referred to as "mobile-terminal position information"). For example, the GPS may be used as the position information obtaining part 22. The mobile-terminal position information includes the latitude information and the longitude information. That is, the position information obtaining part 22 obtains the latitude information and the longitude information of the current position by use of the GPS. The obtained mobile-terminal position information 24*b* is stored in the memory 24.

The communicator 23 is communicatively coupled to the center 30 for transmitting information to and receiving information from the center 30. In an example, the communicator 23 transmits to the center 30 the command of the request for door lock control or the request for starting, or the mobile-terminal position information, and receives from the center 30 the command of the request for communication connection or an inquiry on whether to implement the starting. Communication between the mobile terminal 20 and the center 30 is through the so-called mobile telephone network. Therefore, the communicator 23 also judges whether the communicator 23 is located in "service area" where the communication with the center 30 is available, or in "out-of-service area" where the communication is not available.

The memory 24 stores the program 24*a*, the mobile-terminal position information 24*b*, the setting information 24*c* and an application 24*d*. The memory 24 of the embodiment is nonvolatile semiconductor memory where reading and writing data are electrically available and that is capable of keeping data even in power-off state. For example, EEPROM or a flash memory may be used as the memory 24. However, other memory media or a hard disk drive including a magnetic disk may be used. The program 24*a* is so-called system software that the controller 21 reads out to execute for controlling the mobile terminal 20. The application 24*d* is a control program to control door lock or to start the driving apparatus from a distance.

The display 25 displays an operation screen such as of the application for controlling the door lock or for the remote starting function, or the check screen on which the user checks the vehicle information transmitted by the center 30. For example, a liquid crystal display or an organic EL display may be used as the display 25.

The operation part 26 is an information input apparatus including a mechanical button and a touch panel. The user can make various operations relevant to the control of the door lock and the remote starting function, and can set and change the setting information, by operating the operation part 26. The operation part 26 may be configured as a unit of the display 25.

<1-4. Configuration of Center>

Figure 4:
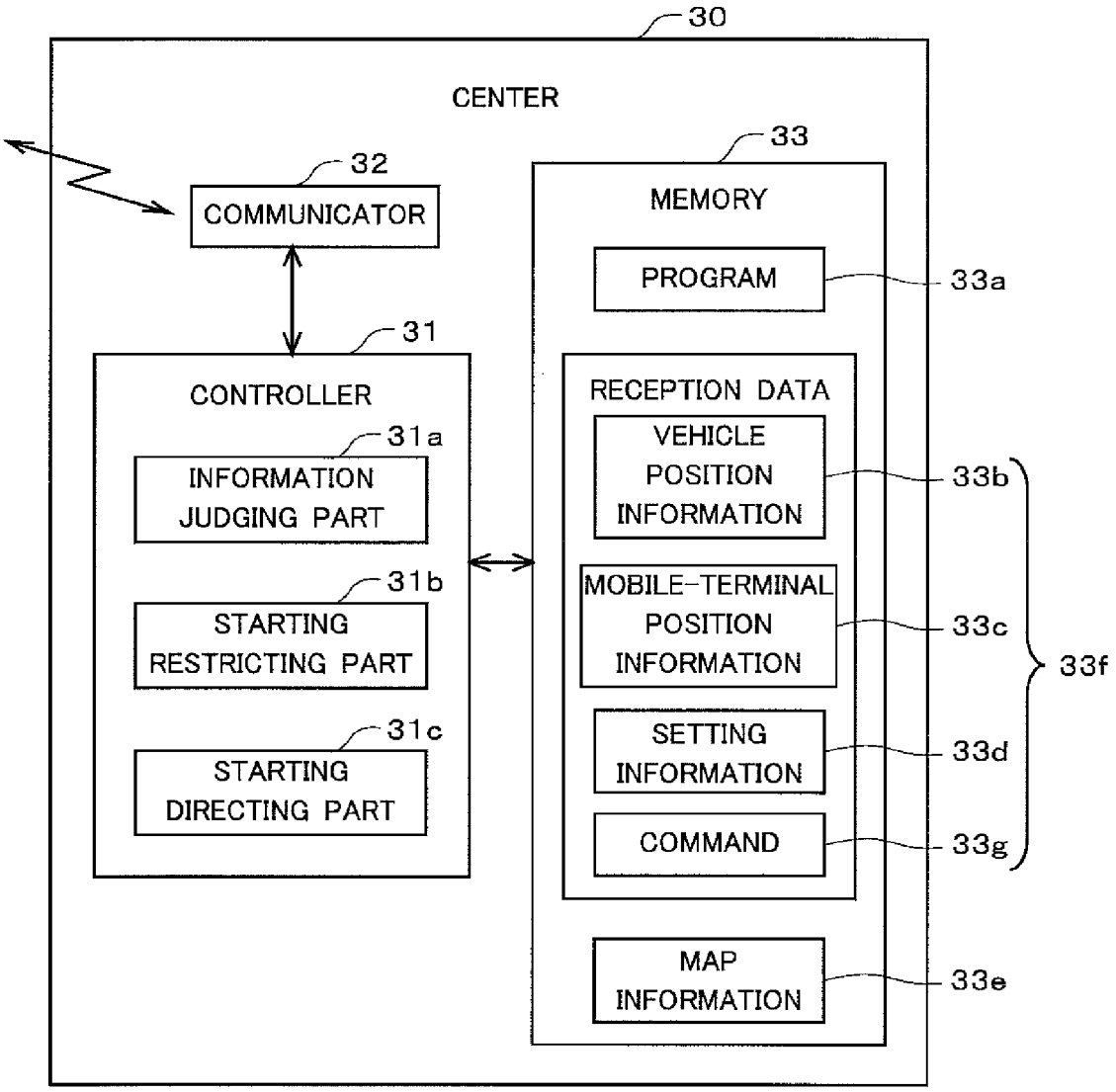
FIG. 4 shows a schematic block diagram of a center.

Next, the configuration of the center 30 is described. FIG. 4 shows a schematic block diagram of the center 30. As shown in FIG. 4, the center 30 includes a controller 31, a communicator 32 and the memory 33.

The controller 31 that includes an information judging part 31*a*, a starting restricting part 31*b* and a starting directing part 31*c*, is a computer that has a CPU, RAM and ROM not shown in FIG. 4. The controller 31 that is connected to the communicator 32, the memory 33 and others included in the center 30, controls the whole of the center 30 by transmitting and receiving information based on the program stored in the memory 33. Arithmetic processing executed by the CPU based on a program 33*a* stored in the memory 33 provides the functions of the controller 31, such as of the information judging part 31*a* and the starting restricting part 31*b*. Since the controller 31 controls the overall processing on the center 30, the controller 31 also controls the processing other than the processing executed by the information judging part 31*a*, the starting restricting part 31*b* and the starting directing part 31*c*.

The information judging part 31*a* judges the contents of the information and the commands received from the vehicle controller 10 or the mobile terminal 20. Concretely, the information judging part 31*a* judges whether the information received from the vehicle controller 10 is the vehicle position information, the information indicating execution of door lock or door unlock, the information indicating execution of starting or stopping the driving apparatus, or the information on the ignition switch being switched on or off. The information judging part 31*a* also judges whether the information received from the mobile terminal 20 is the mobile-terminal position information, the command of the request for door lock control, the command of the request for starting the driving apparatus, or the change information of the setting information.

Upon reception of the command of the request for starting from the mobile terminal 20, the starting restricting part 31*b* judges whether to restrict the starting of the driving apparatus based on the setting information. Concretely, upon the judgment that the command of the request for starting has been received from the mobile terminal 20, the starting restricting part 31*b* judges whether to start the driving apparatus based on the vehicle position information, the mobile-terminal position information and the setting information.

Here is an example case where the distance-restriction function is activated, and where the restriction conditions are set based on the distance between the vehicle position at the time of parking start and the position of the mobile terminal at the time of the request for starting. The starting restricting part 31*b* derives the distance between the vehicle position at the time of parking start and the position of the mobile terminal at the time of the request for starting, based on the vehicle position information and the mobile-terminal position information, and judges whether to restrict the starting of the driving apparatus by comparing the obtained distance and the restriction conditions.

More concretely, the starting restricting part 31*b* calculates the distance between the vehicle and the mobile terminal 20 by comparing vehicle position information 33*b* at the time of the ignition switch being switched off (that is, the vehicle position information at the time of parking start), the vehicle position information 33*b* being read out from the memory 33, and mobile-terminal position information 33*c* received from the mobile terminal 20 (that is, the mobile-terminal position information at the time of the request for starting). Then, the starting restricting part 31*b* reads out from the memory 33 the restriction distance included in setting information 33*d*, and judges whether the calculated distance is equal to or longer than the restriction distance. The restriction distance is one of the restriction conditions, in terms of the distance for restricting the starting.

The starting restricting part 31*b* continues the processing for starting the driving apparatus when the calculated distance is shorter than the restriction distance, or restricts the processing for starting when the calculated distance is equal to or longer than the restriction distance. The restriction of the processing for starting includes prohibition of the processing for starting. In an example, the processing for restricting the processing for starting is to cancel the processing for starting when the processing for starting is prohibited, and to confirm with the user whether to continue the processing for starting when the processing for starting is restricted.

The starting directing part 31*c* executes the processing for transmitting to the vehicle controller 10 the command of the request for door lock control or the command of the request for starting. Concretely, upon receiving the command of the request for door lock control from the mobile terminal 20, the starting directing part 31*c* transmits to the vehicle controller 10 via the communicator 32 the command of the request for door lock control. Upon receiving the command of the request for starting from the mobile terminal 20, when the starting restricting part 31*b* judges that the processing for starting is to be continued, the starting directing part 31*c* transmits to the vehicle controller 10 via the communicator 32 the command of the request for starting.

The communicator 32 is configured to be communicatively coupled to the vehicle controller 10 and to the mobile terminal 20 to transmit and receive information mutually. In an example, the communicator 32 transmits to the vehicle controller 10 the command of the request for door lock control or the command of the request for starting, and transmits to the mobile terminal 20 the execution result or the information for confirming whether to continue the processing for starting regarding the request. The communicator 32, in an example, receives from the vehicle controller 10 the vehicle position information and the vehicle information, and from the mobile terminal 20 the mobile-terminal position information and the command of the request for door lock control or the command of the request for starting. Communications with the vehicle controller 10 and with the mobile terminal 20 are through the so-called mobile telephone network.

The memory 33 stores the program 33*a*, the vehicle position information 33*b*, the mobile-terminal position information 33*c*, the setting information 33*d*, map information 33*e* and a command 33*g*. Reception data 33*f* may be used for collective indication of the vehicle position information 33*b*, the mobile-terminal position information 33*c*, the setting information 33*d* and the command 33*g*. As adaptable configurations, the command 33*g* may be stored in the memory 33 so as to be read out when needed for execution, or may be executed upon reception without being stored in the memory 33.

The memory 33 of the embodiment is nonvolatile semiconductor memory where reading and writing data are electrically available, and that is capable of keeping data even in power-off state. For example, EEPROM or a flash memory may be used as the memory 33. However, other memory media or a hard disk drive including a magnetic disk may be used. The program 33*a* is so-called system software that the controller 31 reads out to execute for controlling the center 30. The map information 33*e* includes the road information and the facility information around the country or in a predetermined wide area.

<1-5. Processing on Vehicle Controller>

Next, the processing on the vehicle controller 10 is described. Each of FIG. 5, FIG. 6, FIG. 7, FIG. 8, FIG. 9 and FIG. 10 shows a flowchart of the processing on the vehicle controller 10.

Figure 5:
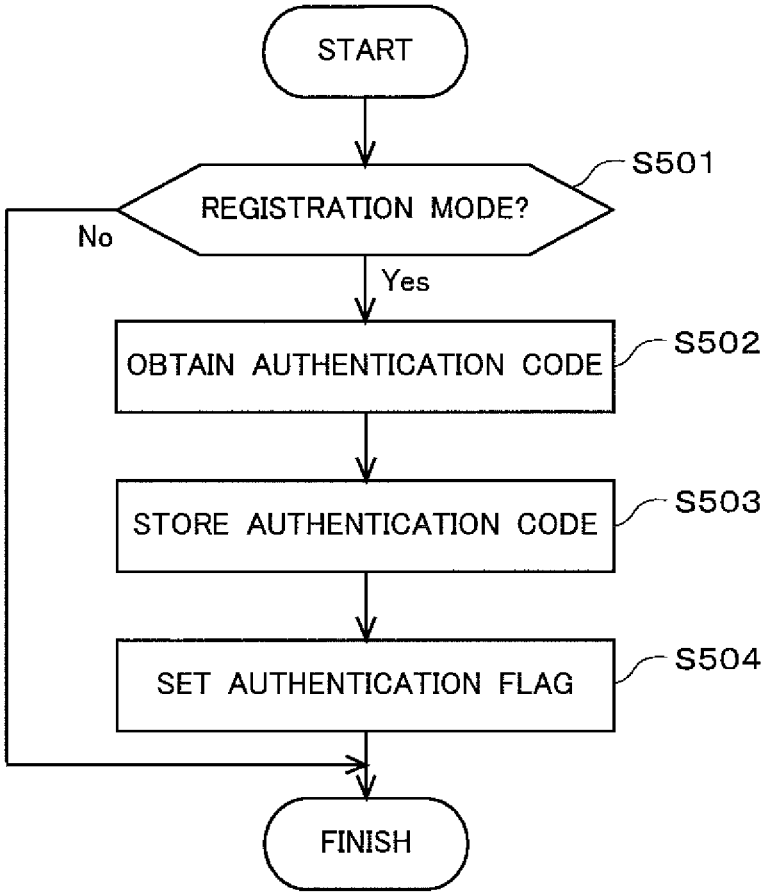
FIG. 5 shows a flowchart of the processing on the vehicle controller.

When the vehicle controller 10 is installed on the vehicle for the first time, the vehicle controller 10 executes the processing for registering the immobilizer. The processing for registering the immobilizer is to store in the vehicle controller 10 the authentication code for executing the processing for authentication with the immobilizer at the time of starting the driving apparatus. Thus, described first is the processing for registering the immobilizer. FIG. 5 is a flowchart of the processing for registering the immobilizer.

The processing for registering the immobilizer is executed when the vehicle controller 10 is installed on the vehicle. After the vehicle controller 10 is installed on the vehicle and is powered on, the processing for registering the immobilizer is started. The vehicle controller 10 has a registration mode that executes the processing for registering the immobilizer. When the vehicle controller 10 is powered on, the vehicle controller 10 judges whether the restriction mode is activated (step S501).

When the registration mode is not activated (No at the step S501), the procedure is finished without execution of the step for registering the immobilizer. When the registration mode is activated (Yes at the step S501), the vehicle controller 10 obtains the authentication code from the verification ECU (step S502). This may be executed by the processing where the vehicle controller 10 has the verification ECU transmit the authentication code, or the verification ECU may send the authentication code when detecting that the vehicle controller 10 is installed on the vehicle and judging that the registration mode is activated.

Next, the vehicle controller 10 stores the obtained authentication code in the first memory 14 (step S503). After storing the authentication code in the first memory 14, the vehicle controller 10 sets the authentication flag in the second memory 15 (step S504). This enables the vehicle controller 10 to complete the registration of the immobilizer properly, and the processing for registering the immobilizer is finished.

Figure 6:
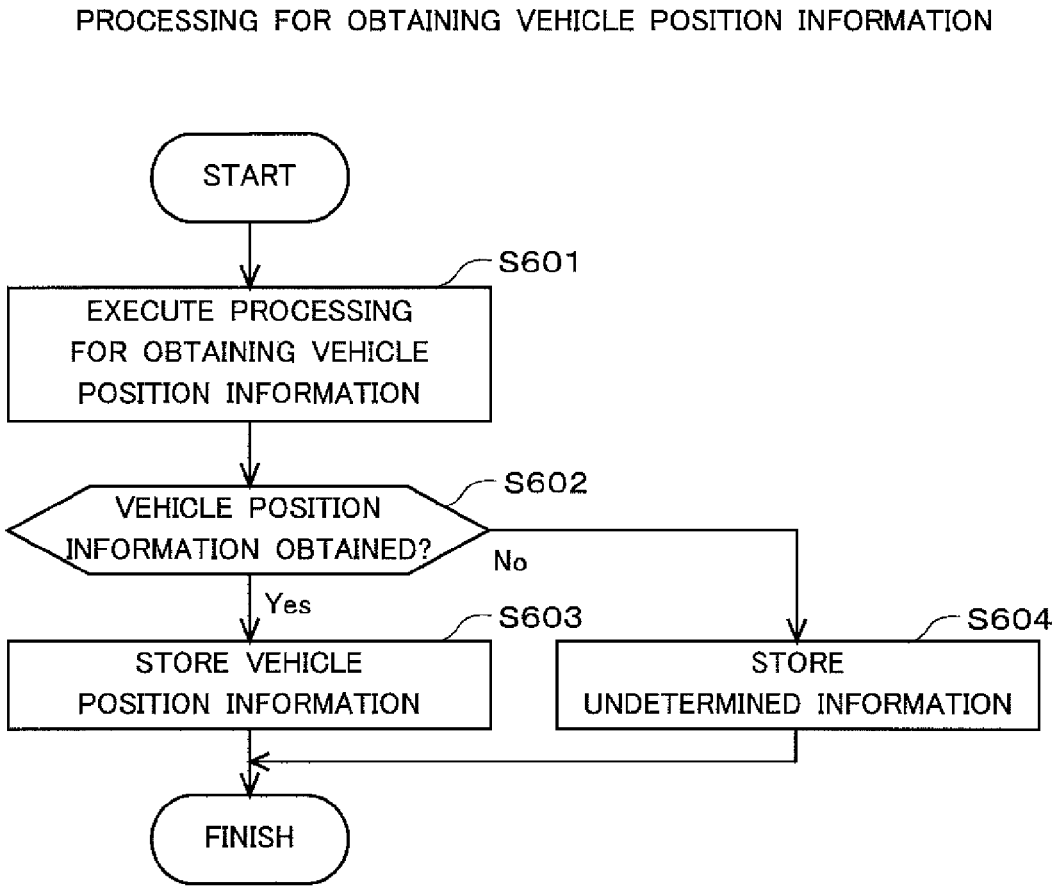
FIG. 6 shows another flowchart of the processing on the vehicle controller.

The vehicle controller 10 obtains the vehicle position information periodically while the ignition switch of the vehicle is in the on-state. Here, described is the processing on the vehicle controller 10 for obtaining the vehicle position information. FIG. 6 shows the flowchart of the processing on the vehicle controller 10 for obtaining the vehicle position information.

First, the position information obtaining part 12 executes the processing for obtaining the vehicle position information, for example, every 50 ms or 100 ms (step S601). After executing the processing for obtaining the vehicle position information, the position information obtaining part 12 judges whether the vehicle position information has been really obtained (step S602). The vehicle position information includes the latitude information and the longitude information. Thus, in an example, when the position information obtaining part 12 has succeeded in appropriately obtaining these of the latitude information and the longitude information, it is judged that the vehicle position information has been obtained. When the position information obtaining part 12 has not succeeded in obtaining them appropriately, it is judged that the vehicle position information has not been obtained.

When judging that the vehicle position information has been obtained (Yes at the step S602), the position information obtaining part 12 stores the obtained vehicle position information in the first memory 14 (step S603). When judging that the vehicle position information has not been obtained (No at the step S602), the position information obtaining part 12 stores the undetermined-information in the first memory 14 (step S604). In this case, the vehicle position information corresponds to the undetermined-information. The vehicle controller 10 repeats the same processing for obtaining the vehicle position information periodically afterward.

Figure 7:
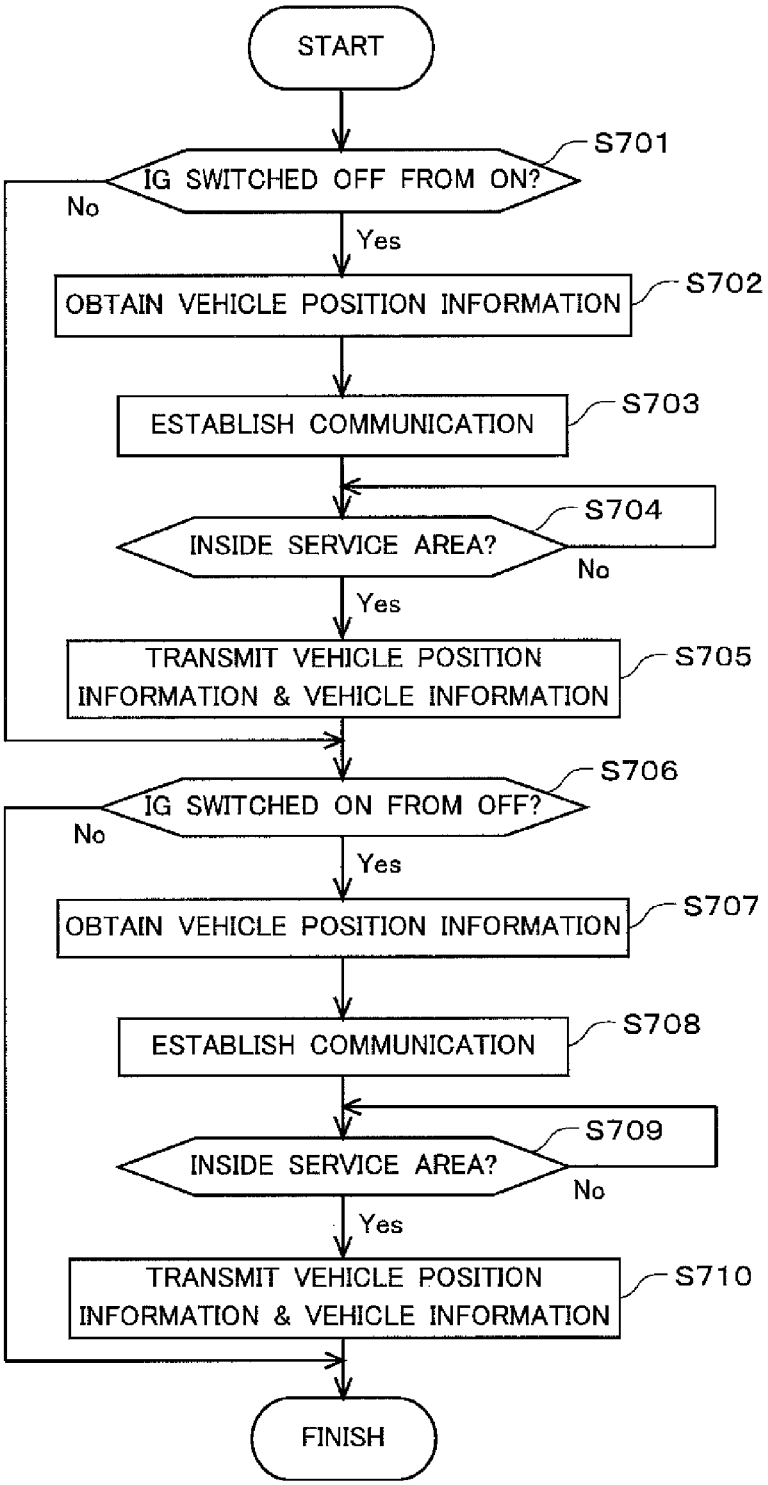
FIG. 7 shows another flowchart of the processing on the vehicle controller.

When the ignition switch is manually switched on or off, the vehicle controller 10 executes the processing for transmitting to the center 30 the vehicle position information and the vehicle information. Here, described is the processing on the vehicle controller 10 for transmitting the vehicle position information and the vehicle information. FIG. 7 shows the flowchart of the processing on the vehicle controller 10 for transmitting the vehicle position information and the vehicle information to the center 30. In the figures, the ignition switch is indicated as "IG."

First, the vehicle information obtaining part 11*a* detects whether the ignition switch has been manually switched off from the on-state (step S701). Concretely, while the ignition switch is in the on-state, upon reception via CAN from a power source ECU, of the signal indicating that the ignition switch is in the off-state, the vehicle information obtaining part 11*a* detects that the ignition switch has been switched off from the on-state.

When the vehicle information obtaining part 11*a* does not detect that the ignition switch has been switched off from the on-state (No at the step S701), the procedure moves to the step, described later, for detecting whether the ignition switch has been switched on from the off-state.

When the vehicle information obtaining part 11*a* detects that the ignition switch has been changed off from the on-state (Yes at the step S701), it is judged that the vehicle is now to be parked. Then, the controller 11 obtains the vehicle position information (step S702). Concretely, the controller 11 obtains the vehicle position information at the time of parking start from the position information obtaining part 12. Then, the procedure moves to the next step where the controller 11 transmits the vehicle position information.

The controller 11 establishes the communication with the center 30 (step S703). Concretely, the controller 11 transmits the command of the request for communication connection to the center 30 via the communicator 13. Upon reception of the command of the request for communication connection, the center 30, if available, permits the communication connection to establish the communication.

However, when the vehicle is parked in the area where the communication is not available, it is impossible to establish the communication at the step S703. Therefore, the communicator 13 judges whether the vehicle is in the service area where the communication with the center 30 is available (step S704). That is, when the communication has been established at the step S703, the communicator 13 judges that the vehicle is in the service area for the communication. When the communication has not been established, the communicator 13 judges that the vehicle is in the out-of-service area for the communication.

When judging that the vehicle is in the service area for the communication (Yes at the step S704), the communicator 13 transmits the vehicle position information and the vehicle information to the center 30 (step S705). The vehicle position information to be transmitted is the position information obtained by the position information obtaining part 12 when the ignition switch has been switched off, that is, the parking start position information. The vehicle information to be transmitted is the vehicle information obtained by the vehicle information obtaining part 11*a* when the ignition switch has been switched off, and includes the information indicating that the ignition switch is in the off-state. The vehicle information to be transmitted may include the vehicle information that is stored in the first memory 14 but has not been transmitted, in addition to the information indicating that the ignition switch is in the off-state.

When judging that the vehicle is not in the service area for the communication (No at the step S704), the communicator 13 judges once again whether the vehicle is in the service area. This is because the communication conditions may have been temporarily bad due to bad weather or surround constructions. If so, there is a possibility that the communication conditions are improved later. When the vehicle is not in the service area, the communicator 13 can not transmit the vehicle position information and other information to the center 30. Therefore, the controller 11 stores the information to be transmitted in the first memory 14. After it is judged that the vehicle is in the service area when the communication conditions are improved, the controller 11 executes the processing for transmitting to the center 30 via the communicator 13 the vehicle position information and the vehicle information read out from the first memory 14. However, when the communication conditions are changed from the condition of being in the out-of-service area to the condition of being in the service area, the controller 11 may obtain the new vehicle position information. Then, the controller 11 compares the newly-obtained vehicle position information and the vehicle position information obtained at the time when the ignition switch is switched off, which is stored in the first memory 14. When judging that the two of the vehicle position information are identical, the controller 11 may transmit the newly-obtained vehicle position information to the center 30.

Next, the vehicle information obtaining part 11*a* detects whether the ignition switch has been manually switched on from the off-state (step S706). Concretely, upon reception via the CAN from the power source ECU, of the signal indicating that the ignition switch is in the on-state while the ignition switch is in the off-state, the vehicle information obtaining part 11*a* detects that the ignition switch has been switched on from the off-state.

When the vehicle information obtaining part 11*a* does not detect that the ignition switch has been switched on from the off-state (No at the step S706), the procedure is finished without any execution.

When the vehicle information obtaining part 11*a* detects that the ignition switch has been switched on from the off-state (Yes at the step S706), it is judged that the vehicle is not to be parked any more. Then, the controller 11 obtains the vehicle position information (step S707). Concretely, the controller 11 obtains the vehicle position information at the time of parking end from the position information obtaining part 12. Then, the procedure moves to the next step where the controller 11 transmits the vehicle position information.

The controller 11 establishes the communication with the center 30 (step S708). Concretely, the controller 11 transmits the command of the request for communication connection to the center 30 via the communicator 13. Upon reception of the command of the request for communication connection, the center 30, if available, permits the communication connection to establish the communication. When the communication with the center 30 has been established already, the step can be omitted.

After the communication is established, the communicator 13 periodically judges whether the vehicle is inside the service area where the communication with the center 30 is available (step S709). That is, in the same manner as the step S704 described above, the communicator 13 judges whether the communication with the center 30 is available by monitoring deterioration of the communication condition after the communication with the center 30 has been established.

When judging that the vehicle is in the service area for the communication (Yes at the step S709), the communicator 13 transmits to the center 30 the vehicle position information and the vehicle information (step S710). The vehicle position information to be transmitted is the position information obtained by the position information obtaining part 12 when the ignition switch has been switched on, that is, the position information at the time of parking end. The vehicle information to be transmitted is the vehicle information obtained by the vehicle information obtaining part 11*a* when the ignition switch has been switched on, and includes the information indicating that the ignition switch is in the on-state. The vehicle information to be transmitted may include the vehicle information that is stored in the first memory 14 but has not been transmitted, in addition to the information indicating that the ignition switch is in the on-state.

When judging that the vehicle is not in the service area for the communication (No at the step S709), the communicator 13 judges once again whether the vehicle is in the service area. When the vehicle is not in the service area, the communicator 13 can not transmit the vehicle position information and other information to the center 30. Therefore, the controller 11 stores the information to be transmitted in the first memory 14. After it is judged that the vehicle is in the service area, the controller 11 executes the processing for transmitting to the center 30 via the communicator 13 the vehicle position information and the vehicle information read out from the first memory 14.

As above, when the ignition switch is manually switched on or off, the vehicle controller 10 executes the processing for transmitting to the center 30 the vehicle position information obtained at the time when the ignition switch has been switched on or off, in addition to the information indicating that the ignition switch has been switched on or off. The vehicle controller 10 executes the processing shown in FIG. 7 periodically, for example, every 50 ms or 100 ms.

Figure 8:
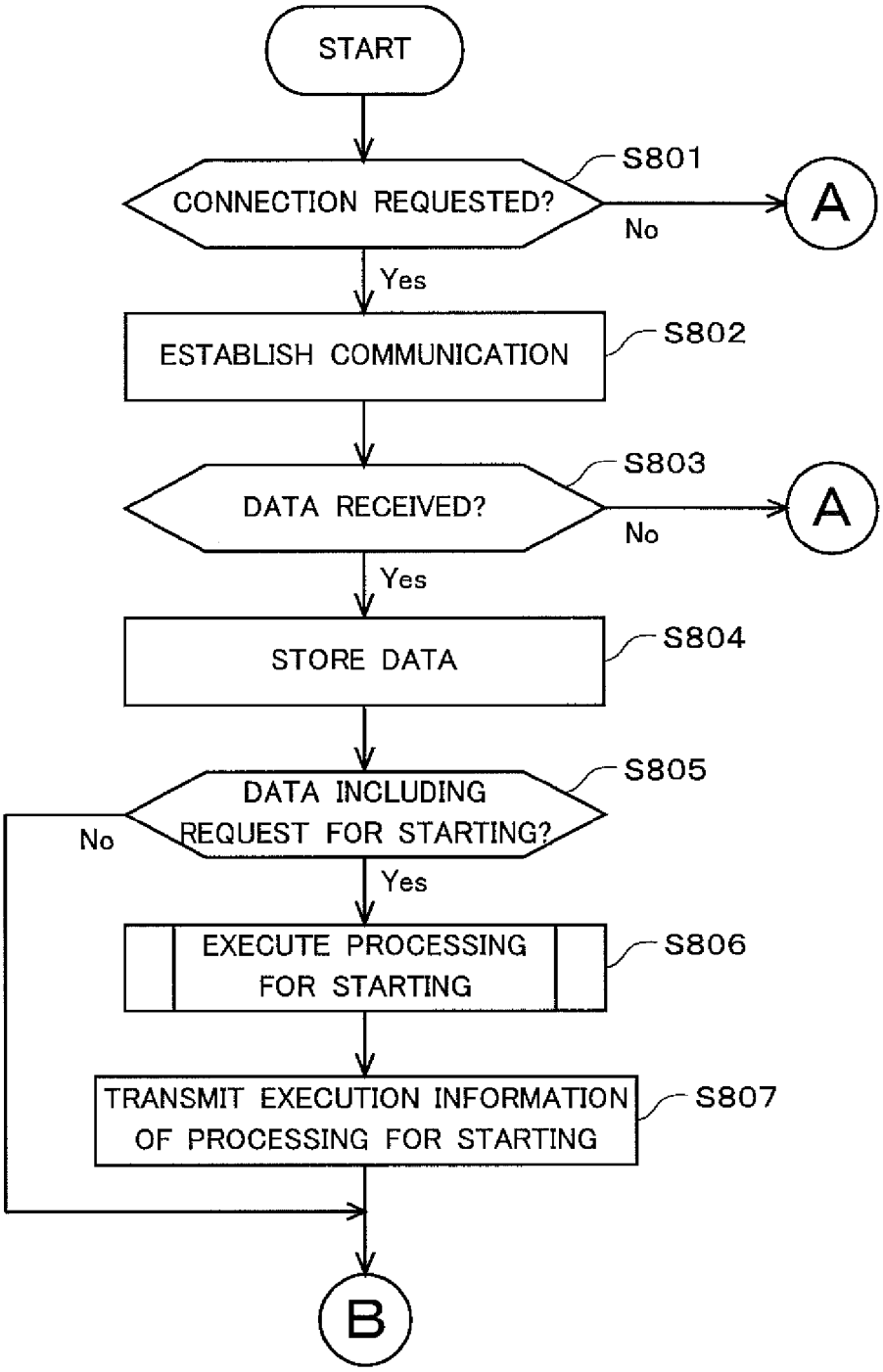
FIG. 8 shows another flowchart of the processing on the vehicle controller.
Figure 9:
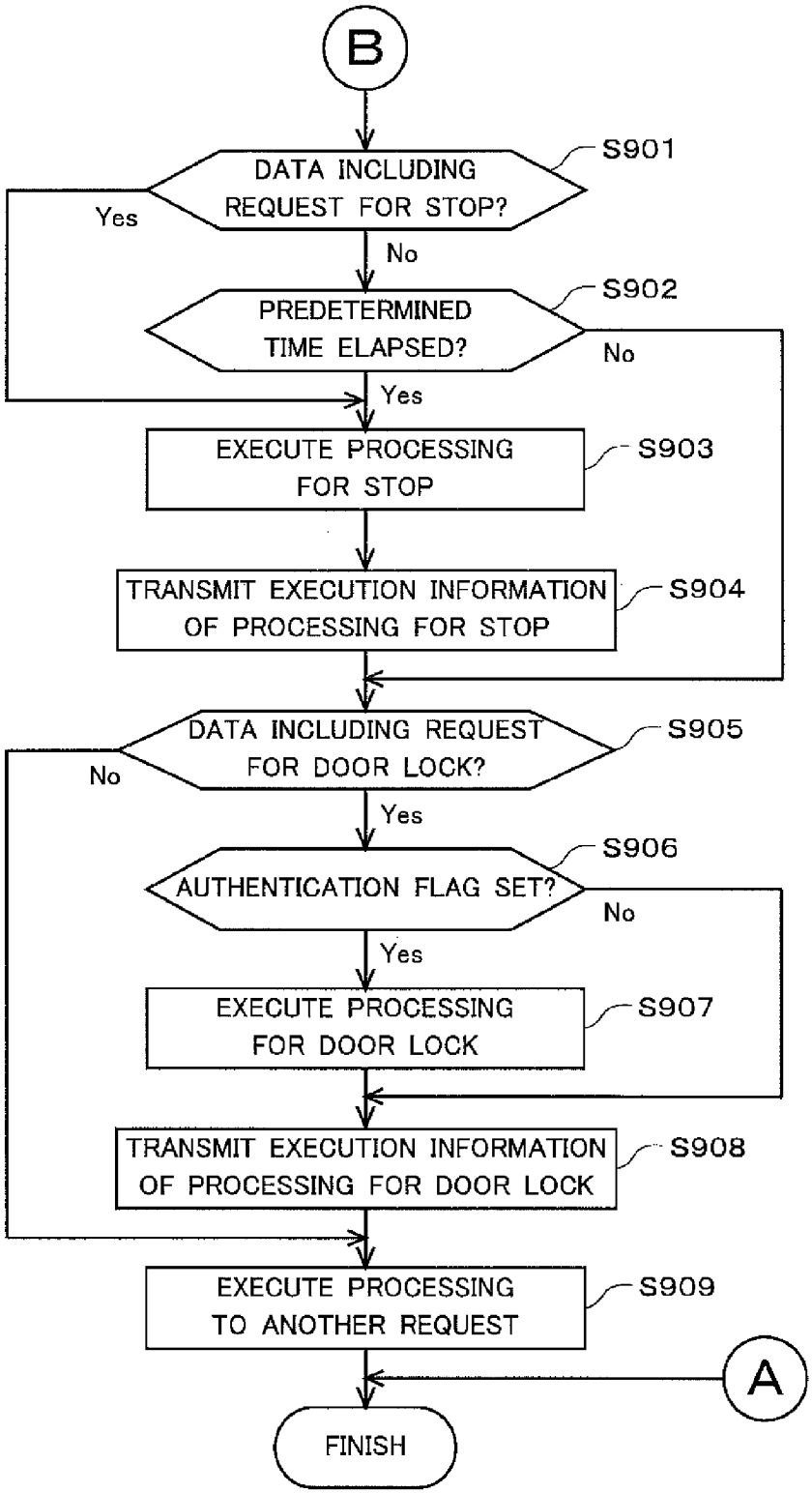
FIG. 9 shows another flowchart of the processing on the vehicle controller.
Figure 10:
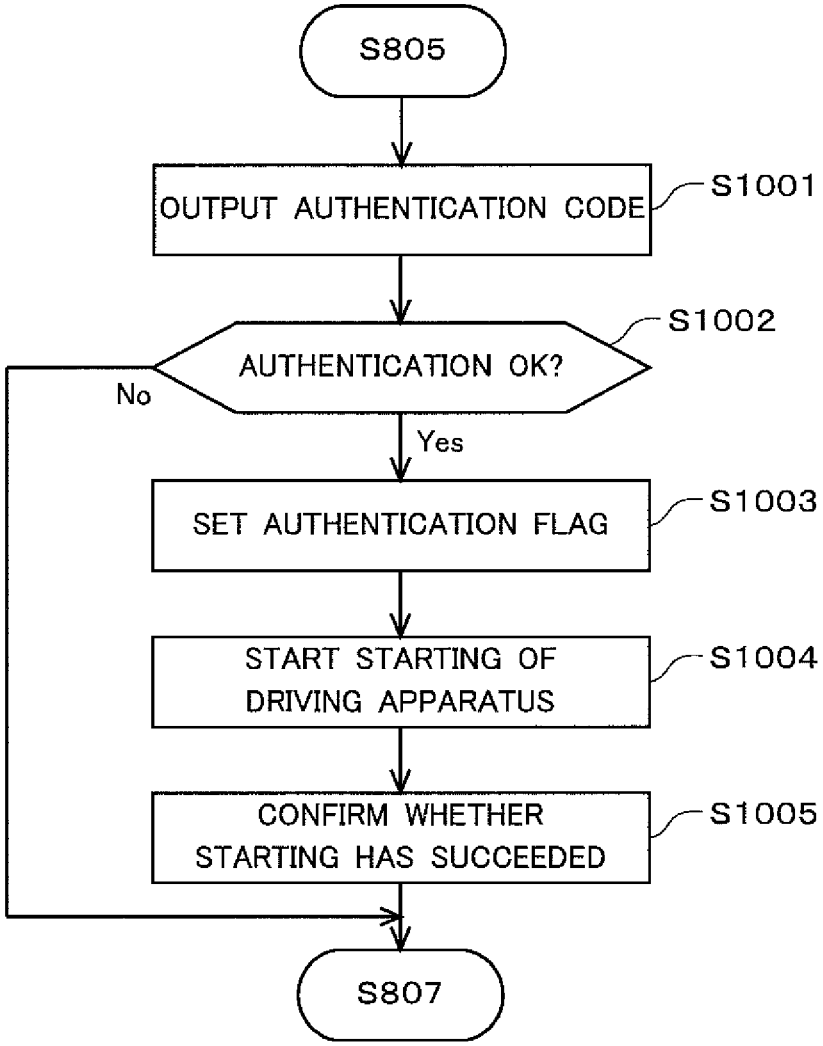
FIG. 10 shows another flowchart of the processing on the vehicle controller.

Described next are the processing for starting and the processing for door lock on the vehicle controller 10. Each of FIG. 8, FIG. 9, and FIG. 10 shows the flowchart of the processing for starting and the processing for door lock on the vehicle controller 10.

First, the controller 11 judges whether the communication connection has been requested from the center 30 (step S801). Concretely, the controller 11 judges whether the command of the request for communication connection has been received from the center 30 via the communicator 13. When the controller 11 judges that the request for communication connection has not been received (No at the step S801), the procedure is finished (A in FIG. 8). When judging that the request for communication connection has been received (Yes at the step S801), the controller 11, if available, permits the communication connection to establish the communication (step S802).

Since the vehicle controller 10, the mobile terminal 20 and the center 30 are associated in advance, the vehicle controller 10 and the center 30 execute the processing for the communication connection after the vehicle controller 10 and the center 30 identify with each other by executing the processing for identification of each other's ID, code or other data. The ID and the code that are used for the processing for identification in this case are the ID and the code to recognize each other when the communication connection is established, and are different from the authentication code described above, for executing the immobilizer authentication on the vehicle controller 10 and the verification ECU in the vehicle.

After the communication is established, the controller 11 judges whether any data have been received from the center 30 (step S803). When the controller 11 judges that any data have not been received (No at the step S803), the procedure is finished (A in FIG. 8).

When judging that some data have been received (Yes at the step S803), the controller 11 stores the received data 14*d* in the first memory 14 (step S804). The controller 11 may store the data 14*d* in the first memory 14 after the information judging part 11*b* judges the contents of the data, or may store the data 14*d* without the judgment. The received data include various kinds of commands, for example, not only the command of the request for door lock control and the command of the request for starting, but the command of the request for transmitting the vehicle position information and the vehicle information.

Next, the information judging part 11*b* judges whether the data received from the center 30 include the command of the request for starting (step S805). The information judging part 11*b* makes this judgment by judging the contents of the received data. In the case where the contents of the received data have been judged at the time of being stored in the first memory 14, the processing for judging whether the command of the request for starting is stored in the first memory 14 may be executed instead.

When the received data include the command of the request for starting (Yes at the step S805), the starting controller 11*c* executes the processing for starting the driving apparatus (step S806). The processing for starting the driving apparatus (step S806) is described in detail, in reference to FIG. 10. FIG. 10 is a flowchart of the processing for starting the driving apparatus.

First, the starting controller 11*c* outputs the authentication code (step S1001). Concretely, the starting controller 11*c* reads out the authentication code from the first memory 14, and transmits to the verification ECU the authentication code read out from the first memory 14. Then, the starting controller 11*c* judges the authentication result (step S1002). This judgment is made based on the authentication result that the starting controller 11*c* has received from the verification ECU. Concretely, upon receiving the authentication code from the starting controller 11*c*, the verification ECU compares the received authentication code with the code for authentication that the verification ECU has stored. The verification ECU gives authentication when the codes are identical, or does not give authentication when the codes are not identical. The verification ECU transmits these authentication results to the starting controller 11*c*. When the received authentication result is the information indicating that authentication has been given, the starting controller 11*c* judges that the result is "authentication OK".

When the authentication result received from the verification ECU is the information indicating that authentication has been given (Yes at the step S1002), the starting controller 11*c* executes the processing for setting the authentication flag (step S1003). That is, when the authentication flag has been set already in the second memory 15, the authentication flag is overwritten. When the authentication flag has not been set, the authentication flag is to be newly set. When the authentication result received from the verification ECU is the information indicating that authentication is not given (No at the step S1002), there is a possibility that the vehicle controller 10 is not the proper one which belongs to the proper user. Thus, the processing for starting is finished. Before the processing for starting is finished, the authentication flag stored in the second memory 15 may be deleted.

Then, the starting controller 11*c* starts the starting of the driving apparatus (step S1004). Concretely, the starting controller 11*c* transmits the direction for starting to the power source ECU via the CAN. The power source ECU makes each of an ACC relay, an ignition switch relay and a starter relay be in an on-state, and transmits an ACC signal, an ignition signal and a starter signal to an engine ECU. Upon reception of these signals, the engine ECU starts a starter motor to start an engine. This enables remote control to start the engine. After transmitting the direction for starting, the starting controller 11*c* judges whether the processing for starting has succeeded (step S1005).

The procedure is back to the step S807 in FIG. 8 where the starting controller 11*c* transmits via the communicator 13 to the center 30 the execution result of whether the processing for starting has succeeded, and the procedure moves to the next step (B in FIG. 8). That is, when the processing for starting has succeeded, the starting controller 11*c* transmits the information indicating that the starting has been completed. When the authentication result is the information indicating that authentication is not given or when the processing for starting has not succeeded, the starting controller 11*c* transmits the information indicating that the starting has failed.

When the information judging part 11*b* judges that the data received from the center 30 do not include the command of the request for starting (No at the step S805), the procedure moves to the next step without execution of the processing for starting by the starting controller 11*c* (B in FIG. 8).

Next, the information judging part 11*b* judges whether the data received from the center 30 include the command of the request for stopping the driving apparatus (step S901). The information judging part 11*b* makes this judgment by judging the contents of the received data, as well. When the received data include the command of the request for stop (Yes at the step S901), the starting controller 11*c* executes the processing for stopping the driving apparatus (step S903). The processing for stop is described later.

When the received data do not include the command of the request for stop (No at the step S901), the timer 11*d* judges whether the predetermined period of time has elapsed since the starting of the driving apparatus (step S902). That is, the timer 11*d* starts measuring time from the starting of the driving apparatus, and judges whether the predetermined period of time has elapsed. The predetermined period of time is, for example, a certain amount of elapsed time since the starting of the driving apparatus, that is, a predetermined so-called warming-up time. For example, 10 minutes may be set as the warming-up time. Or, 20 minutes at maximum may be set as the total time of multiple warming-up operations. However, the predetermined period of time is not limited to these above. An appropriate period of time is permitted to be set.

When the timer 11*d* judges that the predetermined period of time has elapsed since the starting (Yes at the step S902), the starting controller 11*e* executes the processing for stopping the driving apparatus (step S903). In an example of the processing for stop, the starting controller 11*c* transmits the signal for stop to the power source ECU via the CAN, and the power source ECU makes each of the ACC relay, the ignition relay and the starter relay be in the off-state to stop the engine drive. This enables remote control to stop the engine.

Then, after executing the processing for stopping the driving apparatus, the starting controller 11*c* transmits to the center 30 via the communicator 13 the information indicating that the processing for stop has been executed (step S904), and the procedure moves to the next step.

When the timer 11*d* judges that the predetermined period of time has not elapsed (No at the step S902), the procedure moves to the next step for judging whether the received data include the request for door lock control.

Next, the information judging part 11*b* judges whether the data received from the center 30 include the command of the request for door lock control (step S905). The command of the request for door lock control in this case is the command of the request for locking doors or the command of the request for unlocking doors. The information judging part 11*b* makes this judgment by judging the contents of the received data, as well.

When the received data include the request for door lock control (Yes at the step S905), the door lock controller 11*e* judges whether the authentication flag is set (step S906). The door lock controller 11*e* makes this judgment by reading out the authentication flag 15*a* stored in the second memory 15. When judging that the authentication flag is set (Yes at the step S906), the door lock controller 11*e* executes the processing for locking the doors or the processing for unlocking the doors in accordance with the contents of the command (step S907). When the door lock controller 11*e* judges that the authentication flag is not set (No at the step S906), the procedure moves to the next step without execution of the processing for door lock.

The case where the authentication flag is set in the second memory 15 is seen when the vehicle controller 10 is associated with the vehicle (immobilizer). That is, the case where the authentication flag is set in the second memory 15 indicates that the vehicle controller 10 belongs to the proper user. Since the door lock controller 11*e* controls the door lock or the door unlock only when the authentication flag is set, the door lock controller 11*e* is capable of controlling the door lock or the door unlock only when receiving the direction from the proper user. When the authentication flag is not set, in an example, it is highly possible that a stranger installs another vehicle controller on the vehicle, and gives direction for locking the doors or unlocking the doors, pretending to be the proper user. In the configuration of the embodiment, in such a case, the door lock controller 11*e* is capable of prohibiting the controls for locking and unlocking the doors.

After the processing for door lock is finished, the door lock controller 11*e* transmits via the communicator 13 to the center 30 the execution result regarding the processing for door lock (step S908), and the procedure moves to the next step. That is, when having executed the processing for door lock, the door lock controller 11*e* transmits the information indicating that the doors have been locked or unlocked. When having failed to execute the processing for door lock, the door lock controller 11*e* transmits the information indicating the prohibition of the processing for locking the doors.

When the information judging part 11*b* judges that the data received from the center 30 do not include the command of the request for door lock control (No at the step S905), the procedure moves to the next step without execution of the processing for door lock by the door lock controller 11*e*.

Next, the controller 11 executes the processing to respond to another request (step S909). The processing to respond to another request is the processing corresponding to another command received when the received data include the command other than the commands of the request for starting and the request for door lock control (hereafter, referred to as "another command").

That is, the information judging part 11*b* judges whether the received data include another command. The controller 11 executes the processing corresponding to the command, if any. In an example, when the received data include the command of the request for transmitting the vehicle information, the controller 11 executes the processing for transmitting the requested vehicle information to the center 30 via the communicator 13. When the information judging part 11*b* judges that the received data do not include any other command, there is nothing to be done at this step. Then, the processing on the vehicle controller 10 is finished.

After the communication with the center 30 is established, the center 30 may terminate the communication, or the vehicle controller 10 may terminate the communication.

<1-6. Processing on Mobile Terminal>

Figure 11:
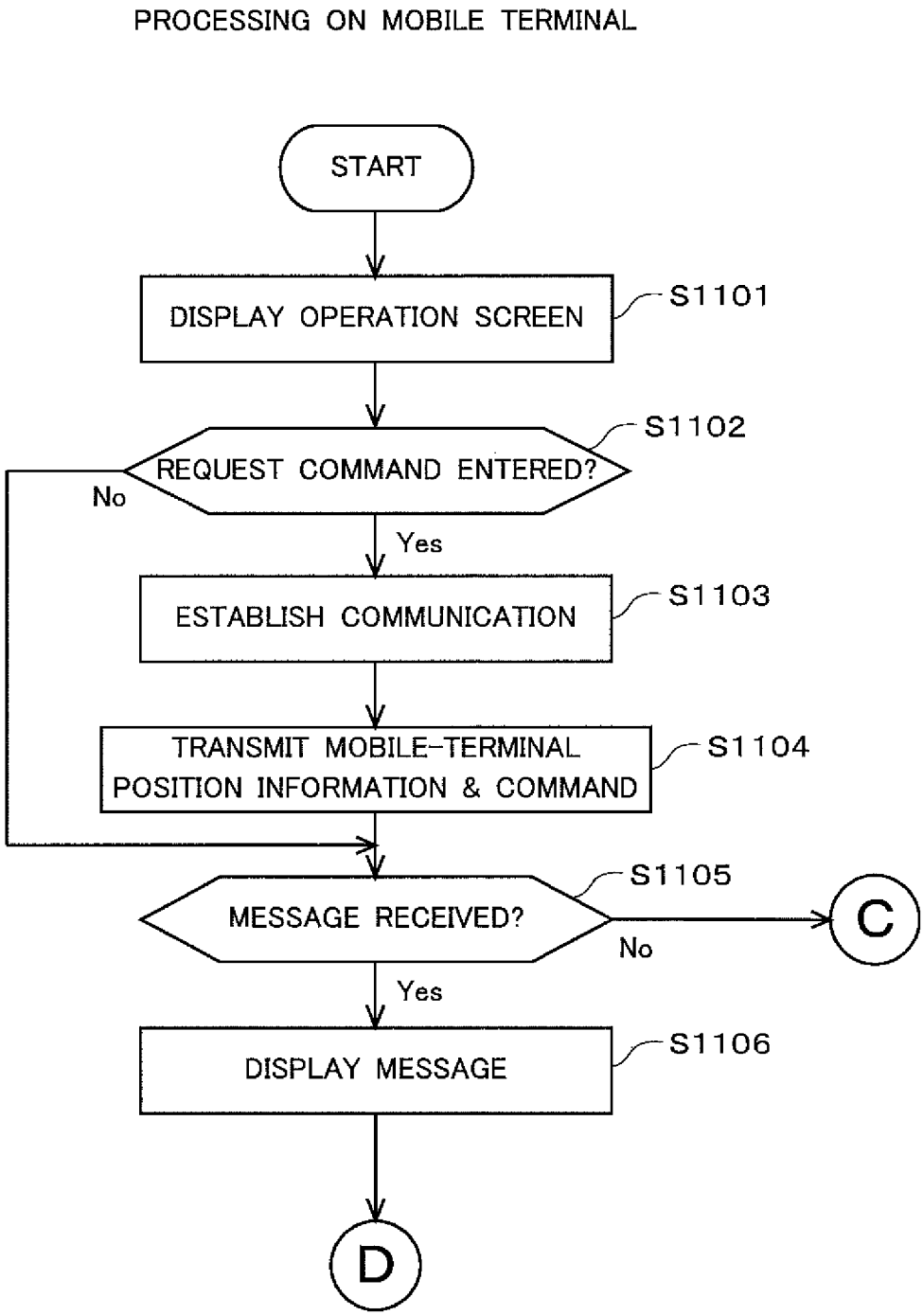
FIG. 11 shows a flowchart of the processing on the mobile terminal.
Figure 12:
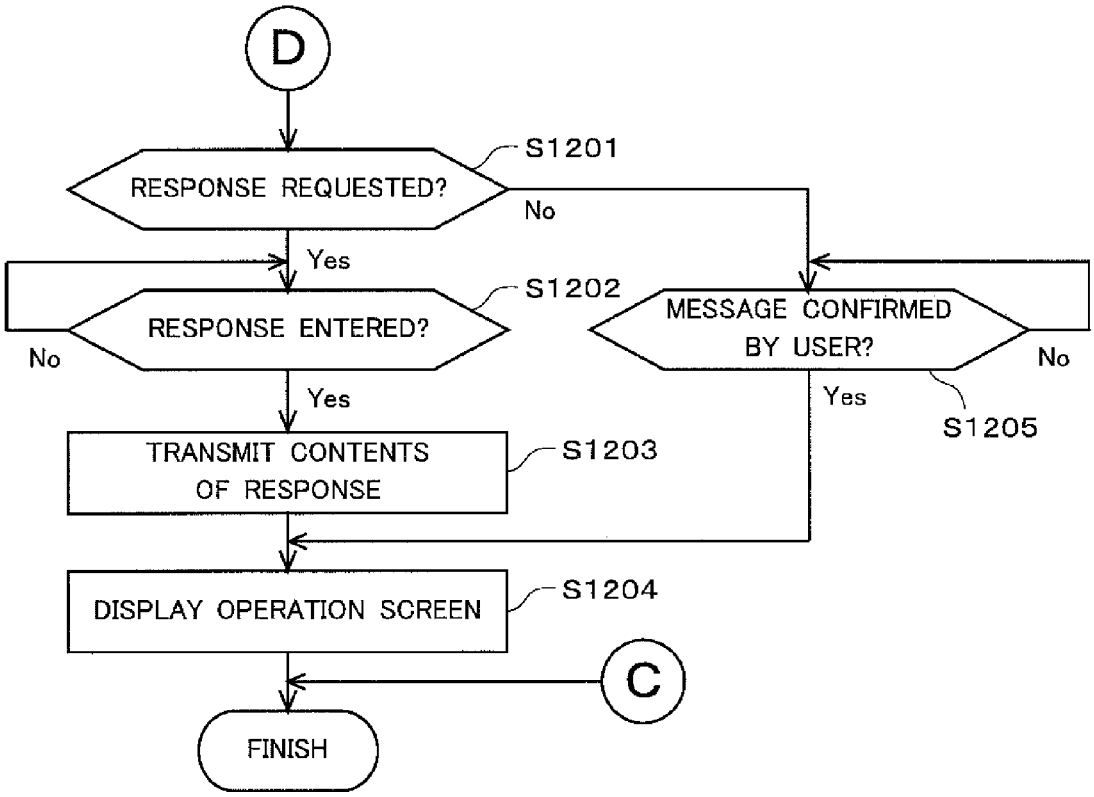
FIG. 12 shows another flowchart of the processing on the mobile terminal.
Figure 13:
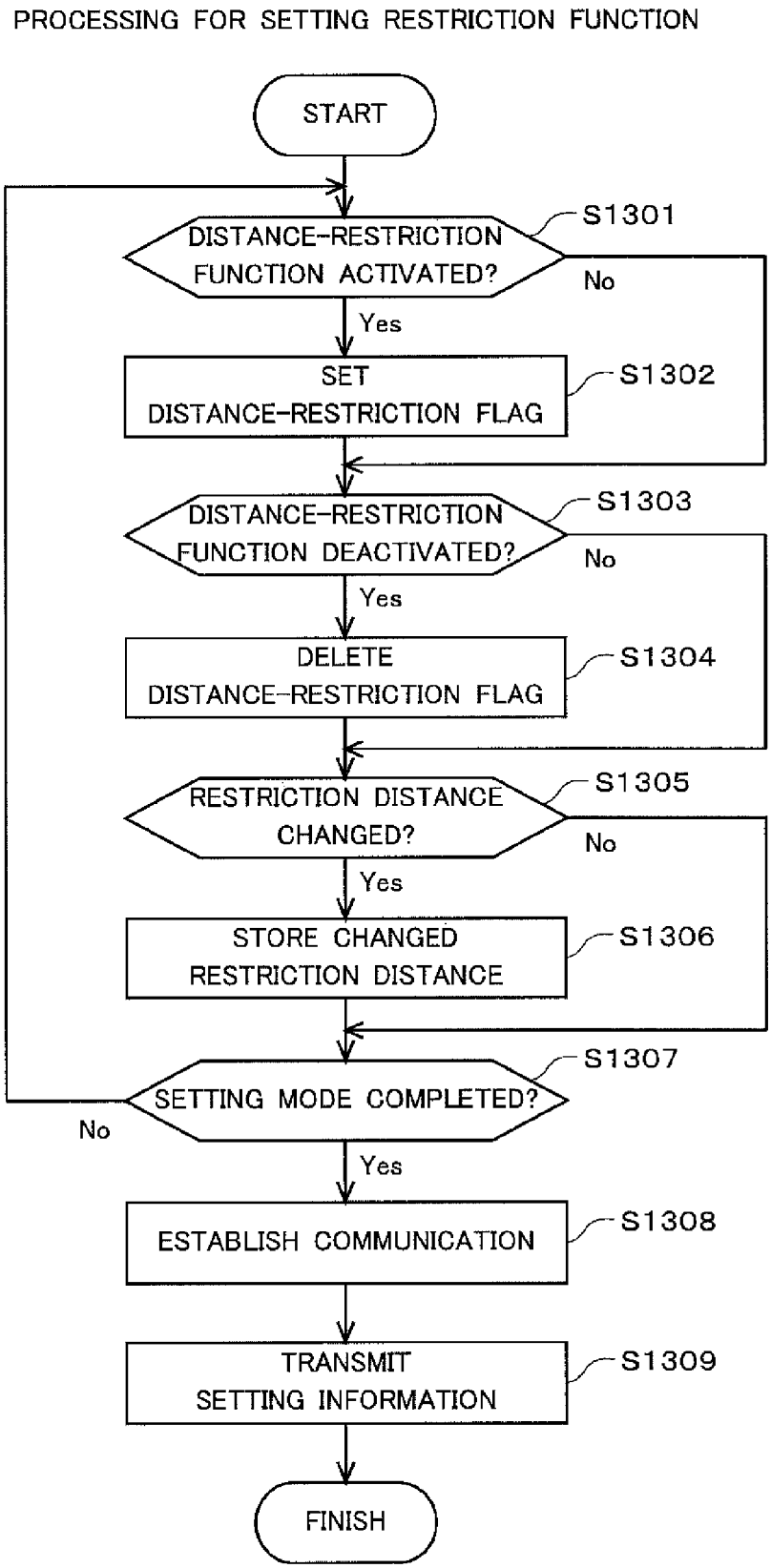
FIG. 13 shows another flowchart of the processing on the mobile terminal.

Next, the processing on the mobile terminal 20 is described. Each of FIG. 11, FIG. 12, and FIG. 13 shows a flowchart of the processing on the mobile terminal 20. Described first is the processing for controlling the vehicle from a distance by use of the mobile terminal 20, such as the processing for the request for door lock control or the processing for the request for starting. Each of FIG. 11 and FIG. 12 shows the flowchart of the processing on the mobile terminal 20.

The processing on the mobile terminal 20 starts with running the application 24*d* for remote operation stored in the mobile terminal 20. After the application 24*d* of the mobile terminal 20 is run, a main operation screen for remote operation is displayed on the display 25 (step S1101). The display controller 21*b* displays the operation screen on the display 25 by reading out the operation screen stored in the application 24*d*.

Next, the controller 21 judges whether the command of a request to the center 30 has been entered by the user on the displayed operation screen (step S1102). When judging that the request command has been entered (Yes at the step S1102), the controller 21 establishes the communication with the center 30 (step S1103). Concretely, the controller 21 transmits the command of the request for communication connection to the center 30 via the communicator 23. Upon reception of the command of the request for communication connection, the center 30, if available, permits the communication connection to establish the communication.

Next, the controller 21 transmits the request command to the center 30 via the communicator 23 (step S1104). When the request command is entered, the information judging part 21*a* judges the contents of the entered command. The command to be entered is, for example, the command of the request for locking doors or unlocking doors, or of the request for starting or stopping the driving apparatus. That is, the controller 21 transmits these request commands to the center 30. Prior to transmission of the entered request command, the position information obtaining part 22 obtains the position information of the mobile terminal 20. Then, the controller 21 transmits the obtained mobile-terminal position information besides the entered request command.

When the controller 21 judges that the request command has not been entered (No at the step S1102), the procedure moves to the next step without execution of the processing for transmitting the request command or others.

Next, the controller 21 judges whether a message has been received from the center 30 (step S1105). The judgment made by the controller 21 includes the judgment on whether any data have been received from the center 30, and whether the received data, if any, correspond to a message. Concretely, the information judging part 21*a* makes this judgment on whether the received data correspond to a message. The message to be received from the center 30 is, for example, a confirmation message relevant to continuation of the processing for remote starting, or a response message to the information requested by the user to the center 30. The concrete examples of the message are the confirmation message for confirming whether to continue the starting in the case where the restriction conditions for the restriction function are not satisfied, and the message for transmitting the contents of the vehicle information that has been inquired by the user to the center 30.

When the controller 21 judges that the message has not been received (No at the step S1105), the processing is finished without execution of the following steps (C in FIG. 11). When judging that the message has been received (Yes at the step S1105), the controller 21 displays the message on the display 25 (step S1106). Then the procedure moves to the next step (D in FIG. 11).

The information judging part 21*a* judges whether the received message is for requesting user's response (step S1201). The message for requesting user's response is, in the examples described above, the confirmation message for confirming whether to continue the starting. The message not for requesting user's response is the message for transmitting the contents of the vehicle information.

When the information judging part 21*a* judges that the received message is for requesting user's response (Yes at the step S1201), the controller 21 monitors whether the user's response has been entered (step S1202). The response is entered when the user makes operations on the operation screen. The step for monitoring the user's response is repeated until when it is judged that the response has been entered (No at the step S1202).

When judging that the response has been entered (Yes at the step S1202), the controller 21 transmits the contents of the response to the center via the communicator 23 (step S1203). Then, the controller 21 redisplays the operation screen on the display (step S1204).

When the information judging part 21*a* judges that the received message is not for requesting the user's response at the step for judging the existence of the response request (No at the step S1201), the controller 21 monitors whether the user has confirmed the displayed message (step S1205). The message not for requesting the user's response is only for presenting the contents to the user. Thus, the controller 21 monitors simply whether the user has confirmed the message. However, the step for monitoring may be omitted, if not needed.

The controller 21 repeats the step for monitoring until it is judged that the user has confirmed the message (No at the step S1205). When judging that the user has confirmed the message (Yes at the step S1205), the controller 21 redisplays the operation screen on the display (step S1204). In an example, the user touches a confirmation button on the operation screen to express confirmation of the message. In this case, the controller 21 judges whether the message has been confirmed by judging whether the confirmation button has been touched.

Later, the user can execute again the processing for remote operation by re-executing the processing from the start. The processing for remote operation is finished when the user shuts down the application 24*d* for remote controlling.

The communication with the center 30 is terminated not just when the application 24*d* for remote controlling is shut down, but is automatically terminated when transmitting necessary data to and receiving necessary data from the center 30 are completed. That is, after the controller 21 has established the communication at the step S1103, the communication is automatically terminated in the case where it is judged that a series of responses from the center in terms of the request command transmitted at the step S1104 have been completed. The case where the responses from the center 30 have been completed is the case such as when the time information at the time of starting has been received or when the message not for requesting the user's response has been received.

Described next is the processing for setting the restriction function and for changing the restriction conditions by use of the mobile terminal 20. FIG. 13 shows the flowchart of the processing for setting the restriction function and for changing the restriction conditions in the case where the distance-restriction function is adopted as the restriction function.

The processing for setting the restriction function and for changing the restriction conditions starts when the user selects the setting mode of the mobile terminal 20. When the setting mode is selected, the restriction function setting part 21*c* judges whether the distance-restriction function of the mobile terminal 20 is activated (step S1301). When the distance-restriction function is activated (Yes at the step S1301), the restriction function setting part 21*c* sets the flag indicating that the distance-restriction function is activated (step S1302). When the distance-restriction function is not activated (No at the step S1301), the flag is not set.

Next, the restriction function setting part 21*c* judges whether the distance-restriction function is deactivated (step S1303). When the distance-restriction function is deactivated (Yes at the step S1303), the restriction function setting part 21*c* deletes the flag that activates the distance-restriction function (step S1304). When the distance-restriction function is not deactivated (No at the step S1303), the flag is not deleted.

Next, the restriction function setting part 21*c* judges whether the restriction distance, one of the restriction conditions, has been changed (step S1305). Upon the change of the restriction distance (Yes at the step S1305), the restriction function setting part 21*c* stores the changed restriction distance in the memory 24 (step S1306). When the restriction distance is not changed (No at the step S1305), the processing for changing the restriction conditions is not executed.

Next, the restriction function setting part 21*c* judges whether the setting mode has been finished (step S1307). When the restriction function setting part 21*c* judges that the setting mode has been finished (Yes at the step S1307), the controller 21 establishes the communication with the center 30 (step S1308). The communication can be established in the same manner as the steps described above. When the communication with the center 30 has been established already, this step may be omitted.

Then, the controller 21 transmits to the center 30 via the communicator 23 the setting information 24*c* read out from the memory 24 after the processing for setting is finished (step S1309), and then, the processing for setting the restriction function and the processing for changing the restriction conditions are finished. When judging that the setting mode has not been finished (No at the step S1307), the restriction function setting part 21*c* re-executes the procedure starting from the step for judging whether the distance-restriction function is activated (step S1301).

<1-7. Processing on Center>

Next, the processing on the center 30 is described. Each of FIG. 14, FIG. 15, FIG. 16 and FIG. 17 shows a flowchart of the processing on the center 30. Described first is the processing on the center 30 for executing door lock and starting by transmitting information to and receiving information from the vehicle controller 10 and the mobile terminal 20, in reference to FIGS. 14, 15 and 16.

The center 30 judges whether the communication connection has been requested from the vehicle controller 10 (step S1401). Concretely, the controller 31 judges whether the command of the request for communication connection has been received from the vehicle controller 10. When judging that the request for communication connection has been received from the vehicle controller 10 (Yes at the step S1401), the controller 31, if available, permits the communication connection with the vehicle controller 10 to establish the communication (step S1402). When the controller 31 judges that the request for communication connection has not been received from the vehicle controller 10 (No at the step S1401), the procedure moves to the next step without execution of the processing for establishing the communication (E in FIG. 14).

Next, the controller 31 judges whether any data have been received from the vehicle controller 10 (step S1403). Concretely, the controller 31 judges whether any data have been received via the communicator 32, or whether the sender of the data, if any, is the vehicle controller 10.

When judging that some data have been received from the vehicle controller 10 (Yes at the step S1403), the controller 31 stores the received data in the memory 33 (step S1404). Then, the information judging part 31*a* judges whether the reception data 33*f* include the vehicle position information 33*b* obtained at the time when the ignition switch has been switched off, that is, the vehicle position information at the time of parking start (step S1405).

When the information judging part 31*a* judges that the reception data 33*f* include the vehicle position information 33*b* obtained at the time when the ignition switch has been switched off (Yes at the step S1405), the controller 31 stores in the memory 33 the vehicle position information 33*b* as "the vehicle position information 33*b* at the time of the ignition switch switched off," that is, as the parking start position (step S1406). When the undetermined-information corresponds to the reception data 33*f*, the undetermined-information is stored in the memory 33 as "the vehicle position information 33*b* at the time of the ignition switch switched off."

When the controller 31 judges that any data have not been received from the vehicle controller 10 (No at the step S1403), and when the information judging part 31*a* judges that the reception data 33*f* do not include the vehicle position information 33*b* at the time of the ignition switch switched off (No at the step S1405), the processing is not executed. Next, the controller 31 terminates the communication with the vehicle controller 10 (step S1407), and the procedure moves to the next step (E in FIG. 14).

Next, the center 30 judges whether the communication connection has been requested from the mobile terminal 20 (step S1501). Concretely, the controller 31 judges whether the command of the request for communication connection has been received from the mobile terminal 20. When judging that the request for communication connection has been received from the mobile terminal 20 (Yes at the step S1501), the controller 31, if available, permits the communication connection with the mobile terminal 20 to establish the communication (step S1502). When the controller 31 judges that the request for communication connection has not been received from the mobile terminal 20 (No at the step S1501), the procedure is finished without execution of the step for establishing the communication (F in FIG. 15).

Next, the controller 31 judges whether any data have been received from the mobile terminal 20 (step S1503). Concretely, the controller 31 judges whether any data have been received via the communicator 32, or whether the sender of the data, if any, is the mobile terminal 20.

When judging that some data have been received from the mobile terminal 20 (Yes at the step S1503), the controller 31 stores the received data in the memory 33 (step S1504). The received data include the mobile-terminal position information. When the controller 31 judges that any data have not been received from the mobile terminal 20 (No at the step S1503), the procedure moves to the next step for terminating the communication without execution of the processing corresponding to the judgment (G in FIG. 15).

After the data received from the mobile terminal 20 are stored, the information judging part 31*a* judges whether the reception data 331 include the command 33*g* of the request for starting (step S1505). When the information judging part 31*a* judges that the received data include the command 33*g* of the request for starting (Yes at the step S1505), the controller 31 executes the processing for transmitting the request for starting the driving apparatus (step S1506). When the information judging part 31*a* judges that the reception data 33*f* do not include the command 33*g* of the request for starting (No at the step S1505), the procedure moves to the next step without execution of the processing for transmitting the request for starting the driving apparatus (H in FIG. 15).

Figure 17:
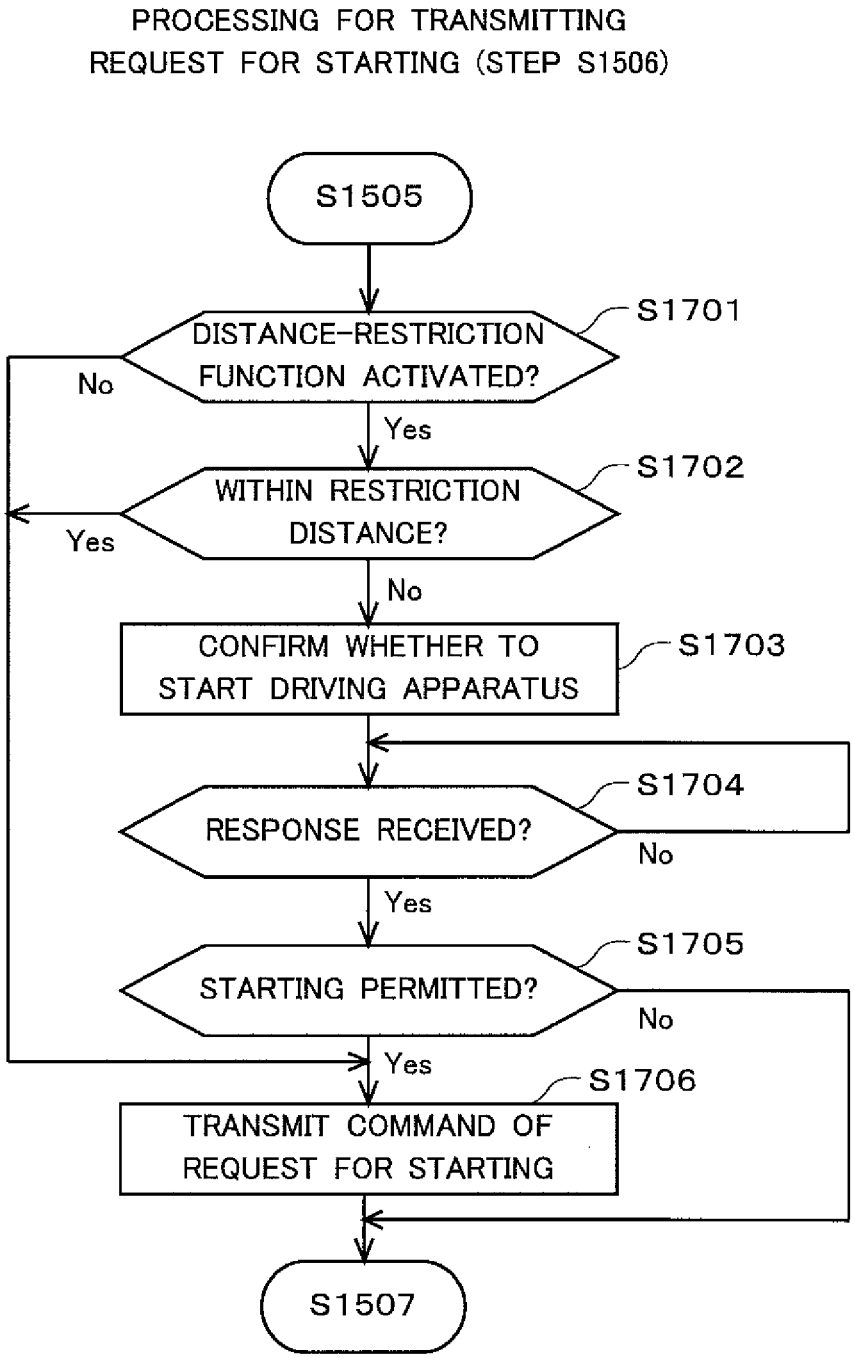
FIG. 17 shows another flowchart of the processing on the center.

Described next is the processing for transmitting the request for starting executed by the controller 31 (step S1506). FIG. 17 is the flowchart of the processing for transmitting the request for starting.

When the information judging part 31*a* judges that the received data include the command 33*g* of the request for starting, the starting restricting part 31*b* judges whether the distance-restriction function is activated (step S1701). In the setting information 33*d* stored in the memory 33 of the center 30, the distance-restriction function is activated initially. However, when the distance-restriction function is activated or deactivated on the mobile terminal 20, and when such information is transmitted as the setting information to the center 30, the setting information 33*d* is rewritten to the newly transmitted setting information. The starting restricting part 31*b* can judge whether the distance-restriction function is activated or deactivated in reference to the stored setting information 33*d*.

When the starting restricting part 31*b* judges that the distance-restriction function is not activated (No at the step S1701), there is no distance restriction. Thus, the procedure on the controller 31 moves to the step for transmitting the command of the request for starting the driving apparatus (step S1706). When judging that the distance-restriction function is activated (Yes at the step S1701), the starting restricting part 31*b* judges whether the distance between the position of the mobile terminal 20 and the vehicle position is equal to or shorter than the restriction distance (step S1702). Concretely, the starting restricting part 31*b* calculates the distance between the position of the mobile terminal 20 and the vehicle position by comparing the mobile-terminal position information 33*c* at the time of the request for starting and the vehicle position information 33*b* at the time of the ignition switch switched off (at the time of parking start) that are stored in the memory 33. Then, the starting restricting part 31*b* compares the calculated distance and the restriction distance read out from the setting information 33*d* that has been stored in the memory 33.

When the starting restricting part 31*b* judges that the calculated distance is equal to or shorter than the restriction distance as a result of the comparison (Yes at the step 1702), the procedure on the controller 31 moves to the step for transmitting the command of the request for starting (step S1706). When the starting restricting part 31*b* judges that the calculated distance is longer than the restriction distance (No at the step S1702), the procedure on the controller 31 moves to the step for confirming whether to continue the processing for starting (step S1703). Concretely, the controller 31 transmits to the mobile terminal 20 via the communicator 32 the information indicating that the distance between the position of the mobile terminal 20 at the time of the request for starting and the vehicle position at the time of parking start is longer than the restriction distance, and the inquiry information for confirmation on whether to continue the processing for starting.

Then, the controller 31 monitors whether the response to the inquiry has been received from the mobile terminal 20 (step S1704). When judging that the response has not been received from the mobile terminal 20 (No at the step S1704), the controller 31 repeats the step for the monitoring until receiving the response. When judging that the response has been received from the mobile terminal 20 (Yes at the step S1704), the controller 31 judges whether the contents of the response indicate that continuing the processing for starting is permitted (step S1705).

When judging that the contents of the response from the mobile terminal 20 indicate that continuing the processing for starting is permitted (Yes at the step S1705), the controller 31 executes the processing for transmitting the command of the request for starting (step S1706), and the procedure of the processing for transmitting the request for starting is finished. When the controller 31 judges that the contents of the response from the mobile terminal 20 indicate that continuing the processing for starting is not permitted (No at the step S1705), the procedure is finished without execution of the processing for transmitting the request for starting.

When judging that the calculated distance is longer than the restriction distance, the controller 31 may cancel the processing for transmitting the request for starting without confirming whether to continue the processing for starting. In this case, when No is obtained at the step S1702, the processing for transmitting the request for starting is finished.

Figure 15:
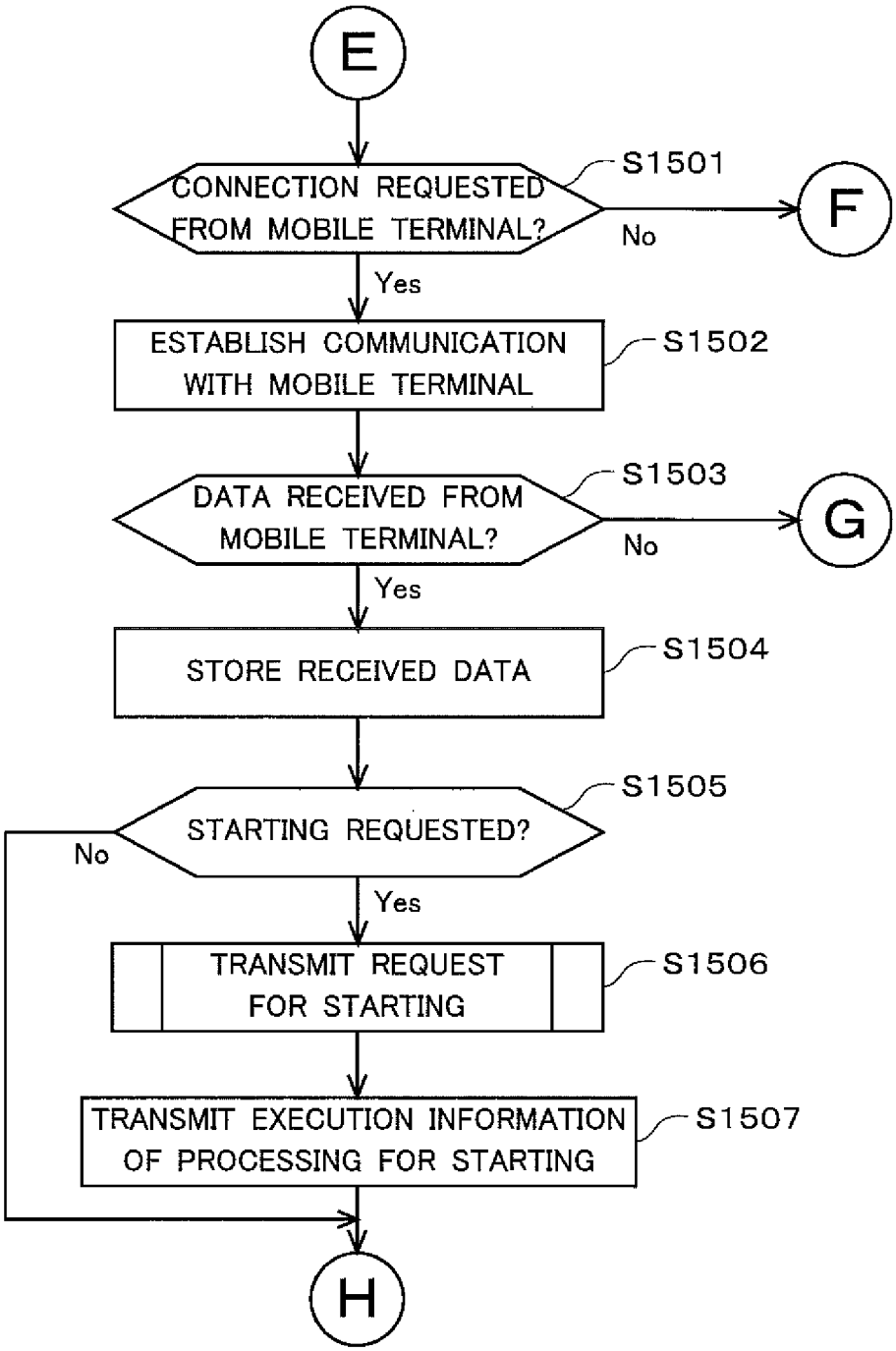
FIG. 15 shows another flowchart of the processing on the center.
Figure 16:
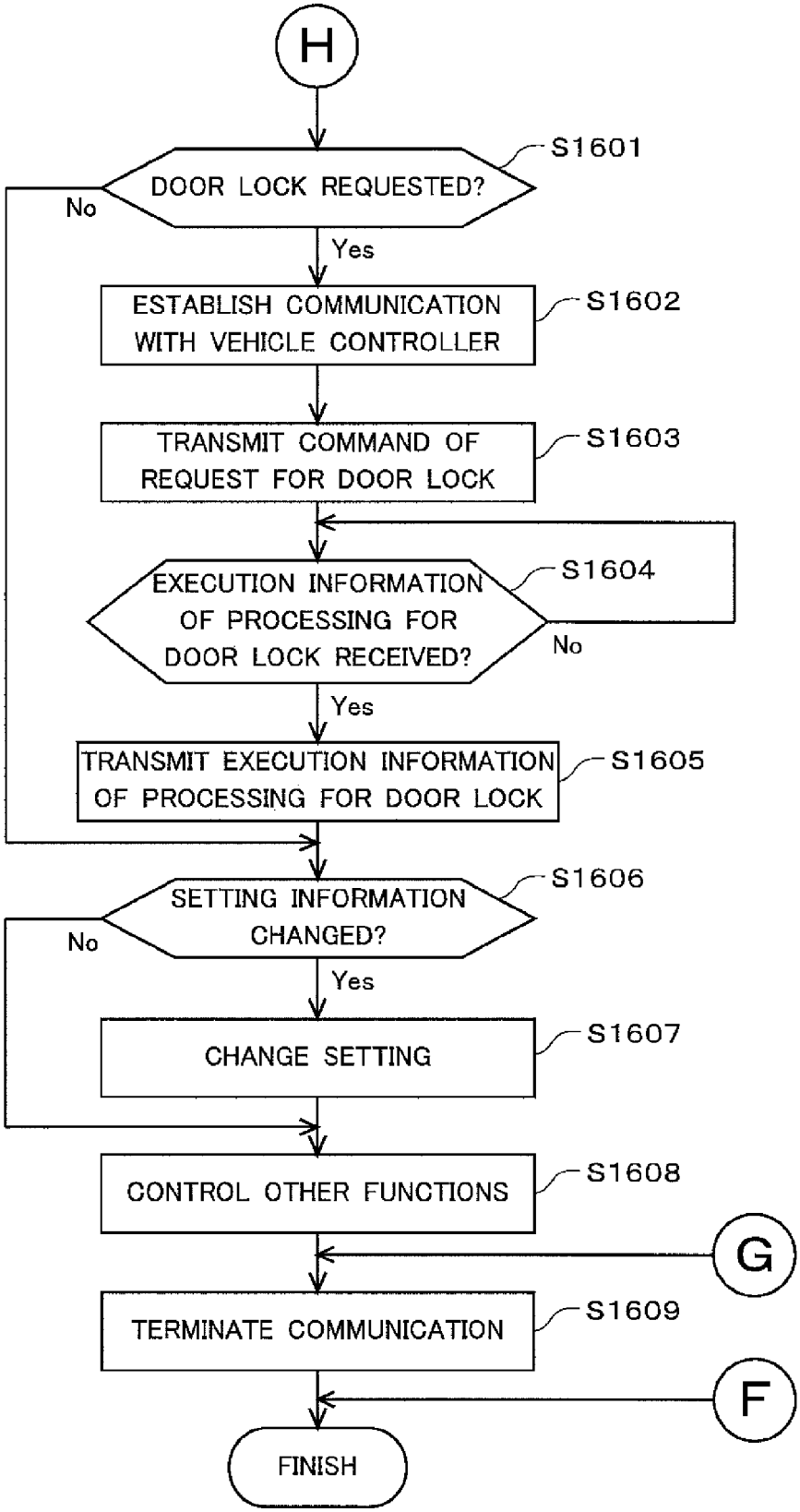
FIG. 16 shows another flowchart of the processing on the center.

The procedure is back to the step S1507 in FIG. 15 where the controller 31 transmits to the mobile terminal 20 the information indicating execution results of the processing for starting, and then moves to the next step (H in FIG. 15). Concretely, the controller 31 transmits the information indicating that the driving apparatus has been started successfully, when transmitting the command of the request for starting to the vehicle controller 10, or when receiving from the vehicle controller 10 the information indicating that the driving apparatus has been successfully started. Or, the controller 31 transmits the information indicating failure in starting the driving apparatus, when not executing the processing for transmitting the command of the request for starting because the starting has not been permitted at the step S1705, or when receiving from the vehicle controller 10 the information indicating the failure in the starting.

Next, the information judging part 31*a* judges whether the reception data 33*f* include the command of the request for door lock control (step S1601). When the information judging part 31*a* judges that the reception data 33*f* include the command of the request for door lock control (Yes at the step S1601), the controller 31 transmits the command of the request for communication connection to the vehicle controller 10 via the communicator 32, and establishes the communication with the vehicle controller 10 (step S1602). When the communication with the vehicle controller 10 has been established already, this step can be omitted.

After the communication is established, the controller 31 transmits the command of the request for door lock control to the vehicle controller 10 via the communicator 32 (step S1603). Then, the controller 31 monitors whether the execution information on the processing for door lock has been received from the vehicle controller 10 (step S1604). Upon receiving the command of the request for door lock control from the center 30, the vehicle controller 10 executes the processing for door lock described above, and transmits the result to the center 30. The center 30 monitors whether the result has been received.

When judging that the execution information on the processing for door lock has not been received from the vehicle controller 10 (No at the step S1604), the controller 31 repeats the step for the monitoring until receiving the execution result. When judging that the execution information on the processing for door lock has been received from the vehicle controller 10 (Yes at the step S1604), the controller 31 transmits the received execution information on the processing for door lock to the mobile terminal 20 (step S1605). That is, the controller 31 transmits to the mobile terminal 20 the information indicating that the processing for door lock has succeeded or the information indicating that the processing for door lock has failed.

When the information judging part 31*a* judges that the reception data 33*f* do not include the command of the request for door lock control (No at the step S1601), the procedure moves to the next step without execution of the processing for transmitting the command of the request for door lock control.

Next, the information judging part 31*a* judges whether the reception data 33*f* include the data for changing the setting information 33*d* (step S1606). When the information judging part 31*a* judges that the reception data 33*f* include the data for changing the setting information 33*d* (Yes at the step S1606), the controller 31 changes the setting information 33*d* based on the received data, and stores the changed setting information 33*d* in the memory 33 (step S1607). That is, the controller 31 executes the processing for rewriting the setting information 33*d* stored in the memory 33 so as to change the setting information 33*d* to the contents after change. When the information judging part 31*a* judges that the reception data 33*f* do not include the data for changing the setting information 33*d* (No at the step S1606), the procedure moves to the next step without execution of the processing for changing the setting.

Next, the controller 31 executes control of other functions (step S1608). Concretely, the information judging part 31*a* first judges whether the reception data 33*f* include another command 33*g*. When the information judging part 31*a* judges that the reception data 33*f* include another command 33*g*, the controller 31 executes the processing corresponding to command 33*g*. When the information judging part 31*a* judges that the reception data 33*f* do not include another command 33*g*, the controller 31 does not execute any other processing.

Then, when the communications with the vehicle controller 10 and with the mobile terminal 20 have been established, the controller 31 executes the processing for terminating the communications with the both (step S1609), the processing on the center 30 is finished.

<2. Second Embodiment>

Next, the second embodiment is described. In the configuration of the first embodiment, upon receiving the command of the request for door lock control, the vehicle controller 10 executes the processing for door lock when the authentication flag is set in the second memory 15, and prohibits the execution of the processing for door lock when the authentication flag is not set in the second memory 15. The authentication flag is set when the processing for registering the immobilizer is executed. However, when the registration mode is not activated, the processing for registration may not be executed, or the authentication flag may not be set because the processing for authentication has not been executed properly.

Therefore, in the configuration of the second embodiment, the vehicle controller 10 re-executes the processing for authentication when the authentication flag has not been set as a result of the judgment on whether the authentication flag is set upon the reception of the command of the request for door lock control. Described hereinafter are mainly the different points from the first embodiment.

<2-1. Outline of System>

A vehicle control system 100 of the second embodiment has the same configuration as the vehicle control system 100 shown in FIG. 1. That is, the configuration of a vehicle controller 10, a mobile terminal 20 and a center 30 of the second embodiment are the same as those of the first embodiment. In the second embodiment, the processing on the mobile terminal 20 and the processing on the center 30 are the same as those of the first embodiment. However, a part of the processing on the vehicle controller 10 is different from that of the first embodiment. Therefore, described hereafter are mainly the different points from the first embodiment, regarding the processing on the vehicle controller 10.

<2-2. Processing on Vehicle Controller>

Figure 18:
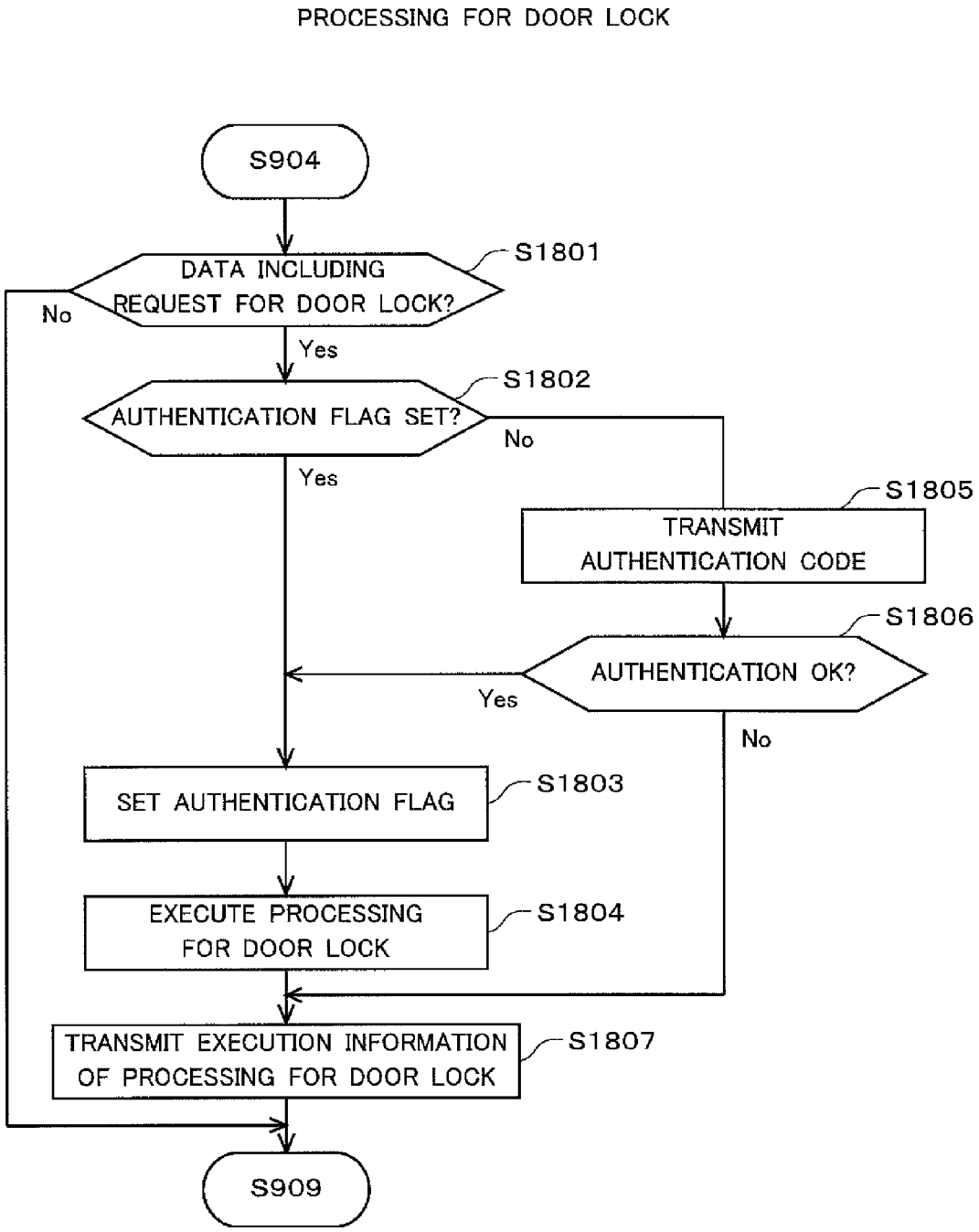
FIG. 18 shows another flowchart of the processing on the vehicle controller.

The processing in the second embodiment is different from the processing on the vehicle controller 10 described in the first embodiment regarding the procedure for door lock control shown in FIG. 9 (from the step S905 to the step S908). Other procedures of the second embodiment are the same as the ones of the first embodiment described in FIGS. 5, 6, 7, 8, 9 and 10. Thus, in the second embodiment, the processing for door lock is described. FIG. 18 shows a flowchart of the processing for door lock of the second embodiment.

After the vehicle controller 10 executes the procedures to the step S904 in the same manner as the first embodiment, an information judging part 11*b* judges whether the data received from the center 30 include the command of the request for door lock control (step S1801). The command of the request for door lock control in this case is the command of the request for locking doors or the command of the request for unlocking doors. The information judging part 11*b* makes this judgment by judging the contents of the received data, as well.

When the received data include the request for door lock control (Yes at the step S1801), a door lock controller 11*e* judges whether the authentication flag is set (step S1802). The door lock controller 11*e* makes this judgment by reading out the authentication flag stored in a second memory 15. When judging that the authentication flag is set (Yes at the step S1802), the door lock controller 11*e* sets the authentication flag in the second memory 15 again (step S1803). That is, the door lock controller 11*e* overwrites the authentication flag in the second memory 15. Then, the door lock controller 11*e* executes the processing for locking the doors or the processing for unlocking the doors in accordance with the contents of the command (step S1804).

When judging that the authentication flag is not set (No at the step S1802), the door lock controller 11*e* transmits the authentication code to the verification ECU (step S1805). In the configuration of the second embodiment, the vehicle controller 10 re-executes the processing for authentication when the authentication flag is not set upon receiving the request for door lock control. That is, when the vehicle controller 10 is installed on the vehicle, or when the request for starting the driving apparatus is received, the processing for authentication (immobilizer authentication) is originally executed. In the second embodiment, when the authentication flag is not set at the time when the request for door lock control is received, pseudo processing for authentication (hereinafter, referred to as "pseudo-authentication") is executed in order to reconfirm the authentication flag. Therefore, when the pseudo-authentication is executed, the door lock controller 11*e* transmits to the verification ECU the information indicating that it is the pseudo-authentication besides the authentication code at the step S1805.

As a result of the processing for authentication executed by the verification ECU, the door lock controller 11*e* judges whether the authentication has been given (step S1806). When receiving from the verification ECU the information indicating that authentication has been given, the door lock controller 11*e* judges that the authentication has been given (Yes at the step S1806), and sets the authentication flag in the second memory 15 (step S1803). Then, the door lock controller 11*e* executes the processing for locking the doors or the processing for unlocking the doors in accordance with the contents of the command (step S1804).

When the information indicating that authentication has been given is not received from the verification ECU even after the predetermined period of time has elapsed, the door lock controller 11*e* judges that authentication has not been given (No at the step S1806). In this case, since there is a possibility that the vehicle controller 10 does not belong to the proper user, the door lock controller 11*e* does not execute the door lock control, and the procedure moves to the next step.

After that, the door lock controller 11*e* transmits to the center 30 via a communicator 13 the information indicating the execution result of the processing for door lock (step S1807). That is, when having executed the processing for door lock, the door lock controller 11*e* transmits the information indicating that the doors have been locked or unlocked. When having not executed the processing for door lock, the door lock controller 11*e* transmits the information indicating the prohibition of the processing for locking the doors. Then, the procedure moves to the step S909.

Figure 19:
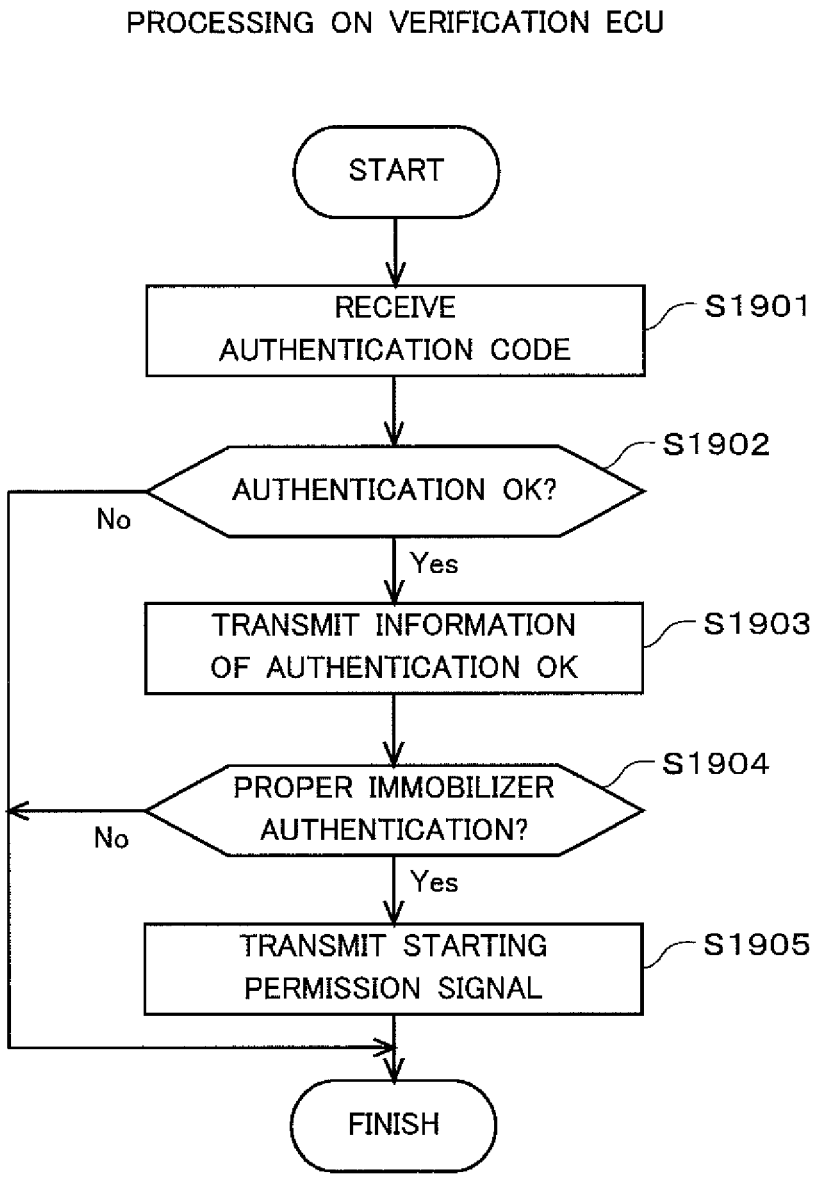
FIG. 19 shows a flowchart of the processing on a verification ECU.

Described next is the processing for authentication on the verification ECU of the second embodiment. FIG. 19 shows a flowchart of the processing on the verification ECU. When receiving the authentication code from the vehicle controller 10 (step S1901), the verification ECU executes the processing for authentication. That is, the verification ECU verifies whether the authentication codes are identical or not, and judges whether to give authentication (step S1902). When the request for starting the driving apparatus is received, the authentication code is transmitted by the vehicle controller 10 and the verification ECU normally executes the processing for authentication (immobilizer authentication). However, in the second embodiment, also when an authentication flag 15*a* is not set in the second memory 15 at the time when the request for door lock control is received, the authentication code is transmitted by the vehicle controller 10 and the verification ECU executes the processing for authentication.

When it is judged that authentication is to be given as a result of the processing for authentication (Yes at the step S1902), the verification ECU transmits to the vehicle controller 10 the information indicating that authentication has been given (step S1903). When it is judged that authentication is not given as a result of the processing for authentication (No at the step S1902), the procedure on the verification ECU is finished.

After transmitting the information indicating that authentication has been given, the verification ECU judges whether the executed processing for authentication is the proper immobilizer authentication (step S1904). Concretely, the verification ECU makes the judgment on whether the information indicating that it is the pseudo-authentication has been received together when receiving the authentication code from the vehicle controller 10, That is, when the information indicating that it is the pseudo-authentication has been received together, the verification ECU judges that the executed processing for authentication is not the proper immobilizer authentication. When such information has not been received, the verification ECU judges that the executed processing for authentication is the proper immobilizer authentication.

As above, since the pseudo-authentication is not the processing for authentication for starting the driving apparatus but is the processing for authentication for judging whether to execute the request for door lock control, the processing for starting the driving apparatus needs to be prohibited even if the authentication codes are identical. However, since the verification ECU normally transmits the permission signal for starting the driving apparatus when the authentication codes are identical, to prevent this, the vehicle controller 10 transmits the signal indicating that it is the pseudo-authentication. Therefore, when the verification ECU judges that the executed processing for authentication is the proper immobilizer authentication (Yes at the step S1904), the verification ECU transmits the starting permission signal to the EFI-ECU (step S1905). When the verification ECU judges that the executed processing for authentication is not the proper immobilizer authentication (No at the step S1904), the procedure is finished without transmitting the starting permission signal.

As described above, the verification ECU transmits the information indicating that authentication has been given when the authentication codes are identical, and does not transmit any information when the authentication codes are not identical. In the configuration of the embodiment, the vehicle controller 10 judges that authentication has been given by receiving the information indicating that authentication has been given, and judges that authentication is not given if no information is received within the predetermined period of time. However, the verification ECU and the vehicle controller 10 are not limited to this configuration. As adaptable configurations, for example, the verification ECU may transmit the information indicating the authentication result whether or not authentication has been given, and the vehicle controller 10 may judge whether authentication has been given by judging whether either of the information has been received.

That is, in this case, when the verification ECU judges that the authentication codes are not identical at the step S1902, the procedure is finished after the processing for transmitting the information indicating that authentication is not given has been executed. At the step S1806, the door lock controller 11*e* judges whether the authentication result received from the verification ECU is the information indicating that authentication has been given. When the authentication result is the information indicating that authentication has been given, the procedure moves to the step S1803. When the authentication result is the information indicating that authentication is not given, the procedure moves to the step S1807.

<3. Third Embodiment>

Next, the third embodiment is described. In the first embodiment and in the second embodiment, when detecting that an IG switch is switched off from an on-state or switched on from an off-state, the vehicle controller 10 executes the processing for transmitting the vehicle position information to the center 30. However, in the configuration where the vehicle controller 10 transmits the vehicle position information to the center 30 every time, there is a risk that a stranger misuses the obtained vehicle position information, when the vehicle controller does not belong to the proper user, for example, when a vehicle is equipped with the vehicle controller that belongs to the stranger.

In an example, when the stranger installs on stranger's mobile terminal the application that displays on stranger's mobile terminal the direction or the distance from the current position of the mobile terminal to the vehicle parking position (hereinafter, referred to as "car finder application"), the stranger can get to the vehicle based on the obtained vehicle position information, by using the car finder application.

Therefore, in the configuration of the third embodiment, only when the vehicle controller belongs to the proper user, the processing for transmitting the vehicle position information is executed, and when the vehicle controller does not belong to the proper user, the processing for transmitting the vehicle position information is not executed. The configuration where the processing for transmitting the vehicle position information is not executed allows the center 30 to judge that the vehicle controller does not belong to the proper user. Thus, in the configuration of the third embodiment, a center 30 may not execute the processing for starting or door lock when judging that the vehicle controller does not belong to the proper user. Described hereinafter are mainly the different points from each of the first embodiment and the second embodiment.

<3-1. Outline of System>

A vehicle control system 100 of the third embodiment has the same configuration as the vehicle control system 100 shown in FIG. 1. That is, the configuration of a vehicle controller 10, a mobile terminal 20 and a center 30 of the third embodiment is identical to the configurations of the first embodiment and the second embodiment. In the third embodiment, the processing on the mobile terminal 20 is the same as the first embodiment and as the second embodiment. However, a part of the processing on the vehicle controller 10 and a part of the processing on the center 30 are different from each of the first embodiment and the second embodiment. Therefore, described hereinafter are mainly the different points from each of the first embodiment and the second embodiment, regarding the processing on the vehicle controller 10 and the center 30.

<3-2. Processing on Vehicle Controller>

Figure 20:
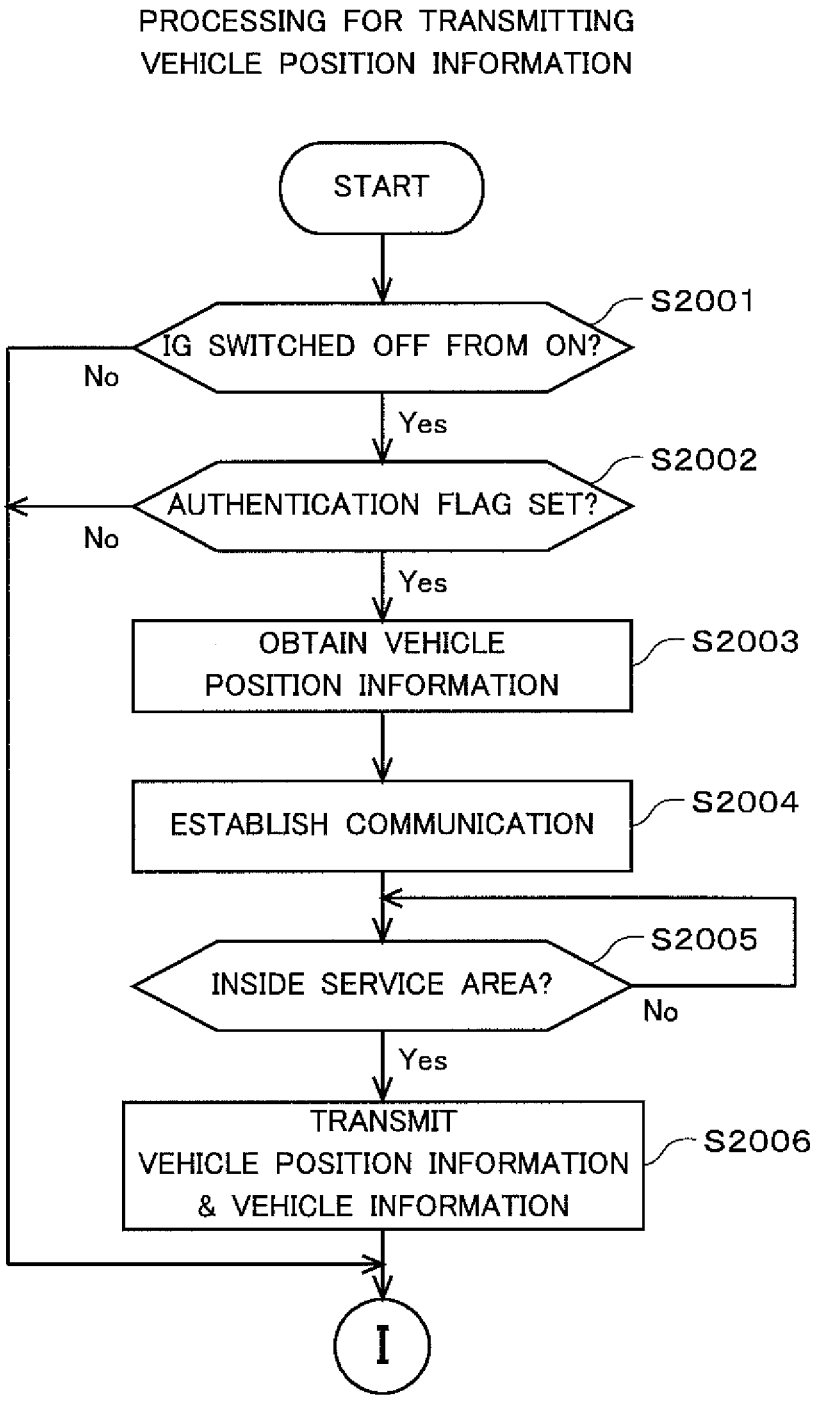
FIG. 20 shows another flowchart of the processing on the vehicle controller.
Figure 21:
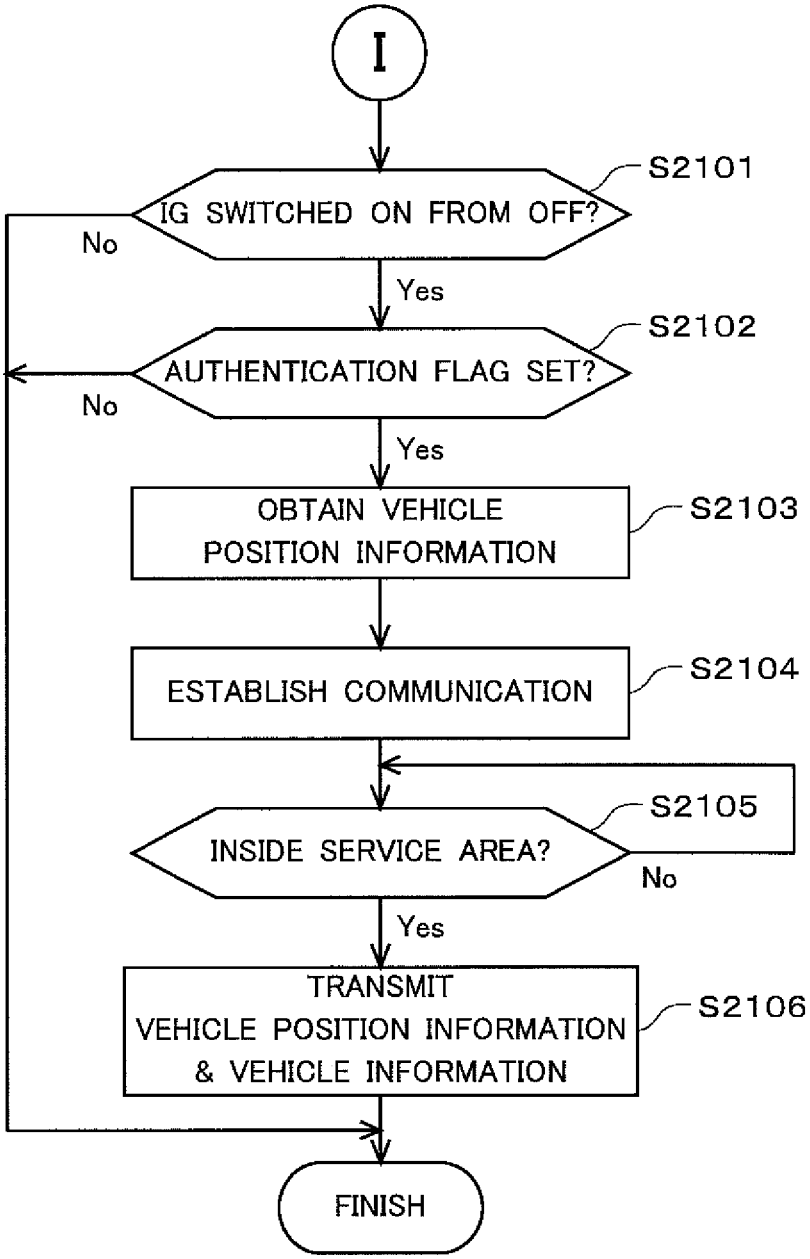
FIG. 21 shows another flowchart of the processing on the vehicle controller.

The processing in the third embodiment is different from the processing on the vehicle controller 10 described in the first embodiment, partially regarding the procedure for transmitting the vehicle position information described in FIG. 7. Other procedures are the same. Thus, in the third embodiment, the processing for transmitting the vehicle position information is described. Each of FIG. 20 and FIG. 21 shows a flowchart of the processing for transmitting the vehicle position information of the third embodiment.

First, a vehicle information obtaining part 11*a* detects whether an ignition switch has been manually switched off from an on-state (step S2001). Concretely, while the ignition switch is in the on-state, upon reception via CAN from a power source ECU, of the signal indicating that the ignition switch is in the off-state, the vehicle information obtaining part 11*a* detects that the ignition switch has been switched off from the on-state.

When the vehicle information obtaining part 11*a* does not detect that the ignition switch has been switched off from the on-state (No at the step S2001), the procedure moves to the step, described later, for detecting whether the ignition switch has been switched on from the off-state (I in FIG. 20).

When the vehicle information obtaining part 11*a* detects that the ignition switch has been switched off from the on-state (Yes at the step S2001), a controller 11 judges whether the authentication flag is set in a second memory 15 (step S2002). The judgment is made in order to judge whether the vehicle controller 10 belongs to the proper user.

Also in the third embodiment, the processing for registering the immobilizer and the processing for immobilizer authentication at the time of starting are executed, and the authentication flag is set in the second memory 15 when the vehicle controller 10 belongs to the proper user. Thus, in the configuration of the embodiment, the controller 11 confirms whether the authentication flag is set in the second memory 15 at the time of transmitting the vehicle position information.

When the controller 11 judges that the authentication flag is not set (No at the step S2002), the procedure moves to the step for detecting whether the ignition switch has been switched on from the off-state, described later (I in FIG. 20).

When judging that the authentication flag is set (Yes at the step S2002), the controller 11 obtains the vehicle position information (step S2003). Then, the controller 11 establishes the communication with the center 30 (step S2004). After that, a communicator 13 judges whether the vehicle is in the service area where the communication with the center 30 is available (step S2005). When judging that the vehicle is in the service area (Yes at the step S2005), the communicator 13 transmits the vehicle position information and the vehicle information to the center 30 (step S2006). When judging that the vehicle is not in the service area (No at the step S2005), the communicator 13 judges again whether the vehicle is in the service area. The details of each of these steps (from the step S2003 to the step S2006) are the same as the steps S702 to S705, described above.

Next, the vehicle information obtaining part 11*a* detects whether the ignition switch has been manually switched on from the off-state (step S2101). Concretely, upon reception via the CAN from the power source ECU, of the signal indicating that the ignition switch is in the on-state while the ignition switch is in the off-state, the vehicle information obtaining part 11*a* detects that the ignition switch has been switched on from the off-state.

When the vehicle information obtaining part 11*a* does not detect that the ignition switch has been switched on from the off-state (No at the step S2101), the procedure is finished without any execution.

When the vehicle information obtaining part 11*a* detects that the ignition switch has been switched on from the off-state (Yes at the step S2101), the controller 11 judges whether the authentication flag is set in the second memory 15 (step S2102). The judgment is made, in this case also, in order to judge whether the vehicle controller 10 belongs to the proper user.

When the controller 11 judges that the authentication flag is not set (No at the step S2102), the procedure is finished without any execution.

When judging that the authentication flag is set (Yes at the step S2102), the controller 11 obtains the vehicle position information (step S2103). Then, the controller 11 establishes the communication with the center 30 (step S2104). After that, the communicator 13 judges whether the vehicle is in the service area where the communication with the center 30 is available (step S2105). When judging that the vehicle is in the service area (Yes at the step S2105), the communicator 13 transmits the vehicle position information and the vehicle information to the center 30 (step S2106). When judging that the vehicle is not in the service area (No at the step S2106), the communicator 13 judges again whether the vehicle is in the service area. The details of each of these steps (from the step S2103 to the step S2106) are the same as the steps S707 to S710, described above.

As above, the vehicle controller 10 confirms whether the authentication flag is set in the second memory 15, when the ignition switch has been manually switched on or off. Through the confirmation, the vehicle controller 10 judges whether the vehicle controller 10 belongs to the proper user. Only when judging that the vehicle controller 10 belongs to the proper user, the vehicle controller 10 executes the processing for transmitting the vehicle position information to the center 30. This prevents a stranger from obtaining the vehicle position by use of a car finder application or other applications even if the stranger installs another vehicle controller on the vehicle.

<3-3. Processing on Center>

Figure 22:
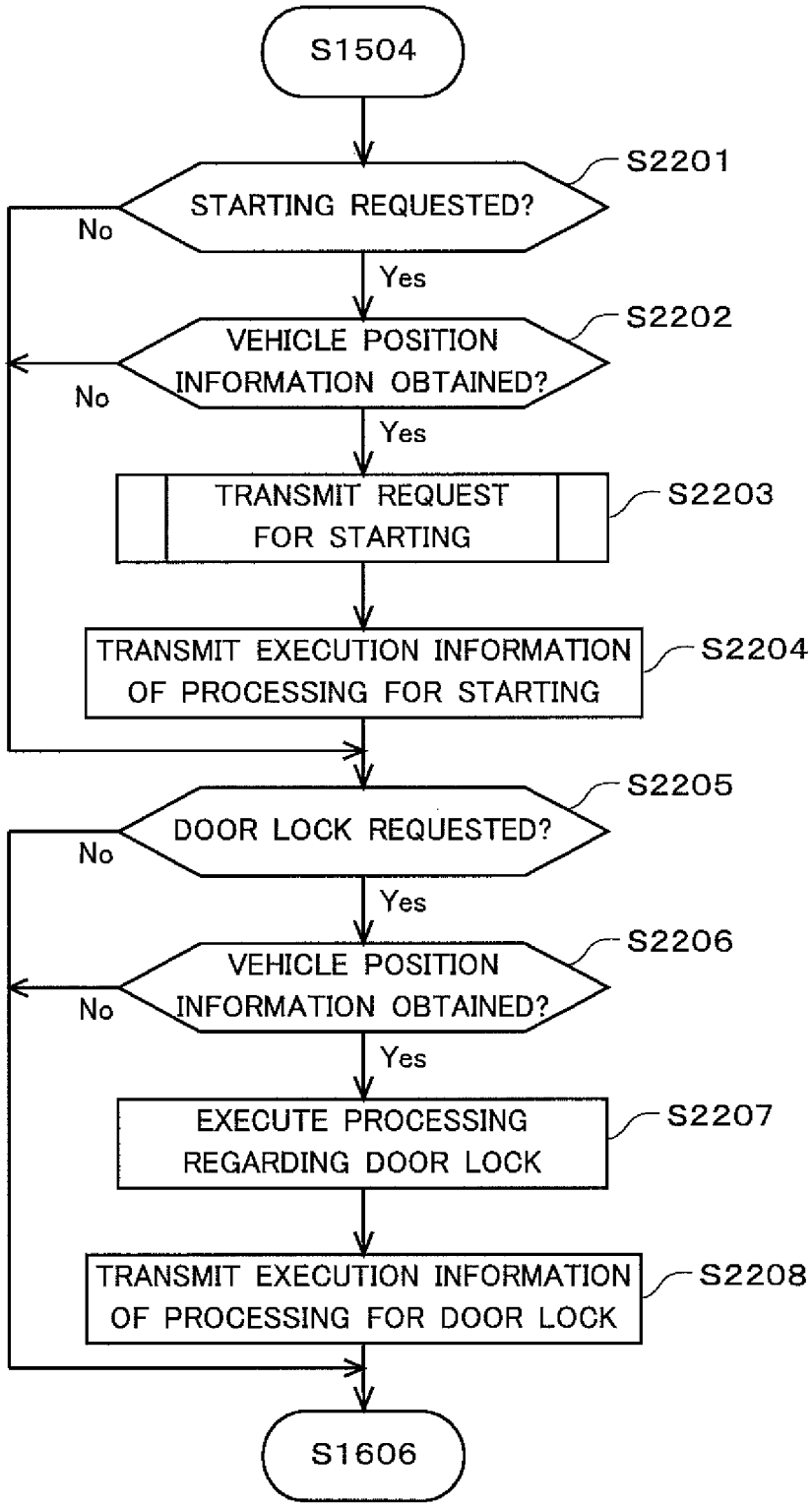
FIG. 22 shows another flowchart of the processing on the center.

The processing in the third embodiment is different from the processing on the center 30 described in the first embodiment, regarding the procedure for confirming whether the vehicle position information has been obtained. Other procedures are the same as the procedures shown in FIG. 14, FIG. 15 and FIG. 16. Therefore, in the third embodiment, the processing on the center 30 for confirming the vehicle position information is mainly described. FIG. 22 shows a flowchart of the processing on the center 30 of the third embodiment.

Figure 14:
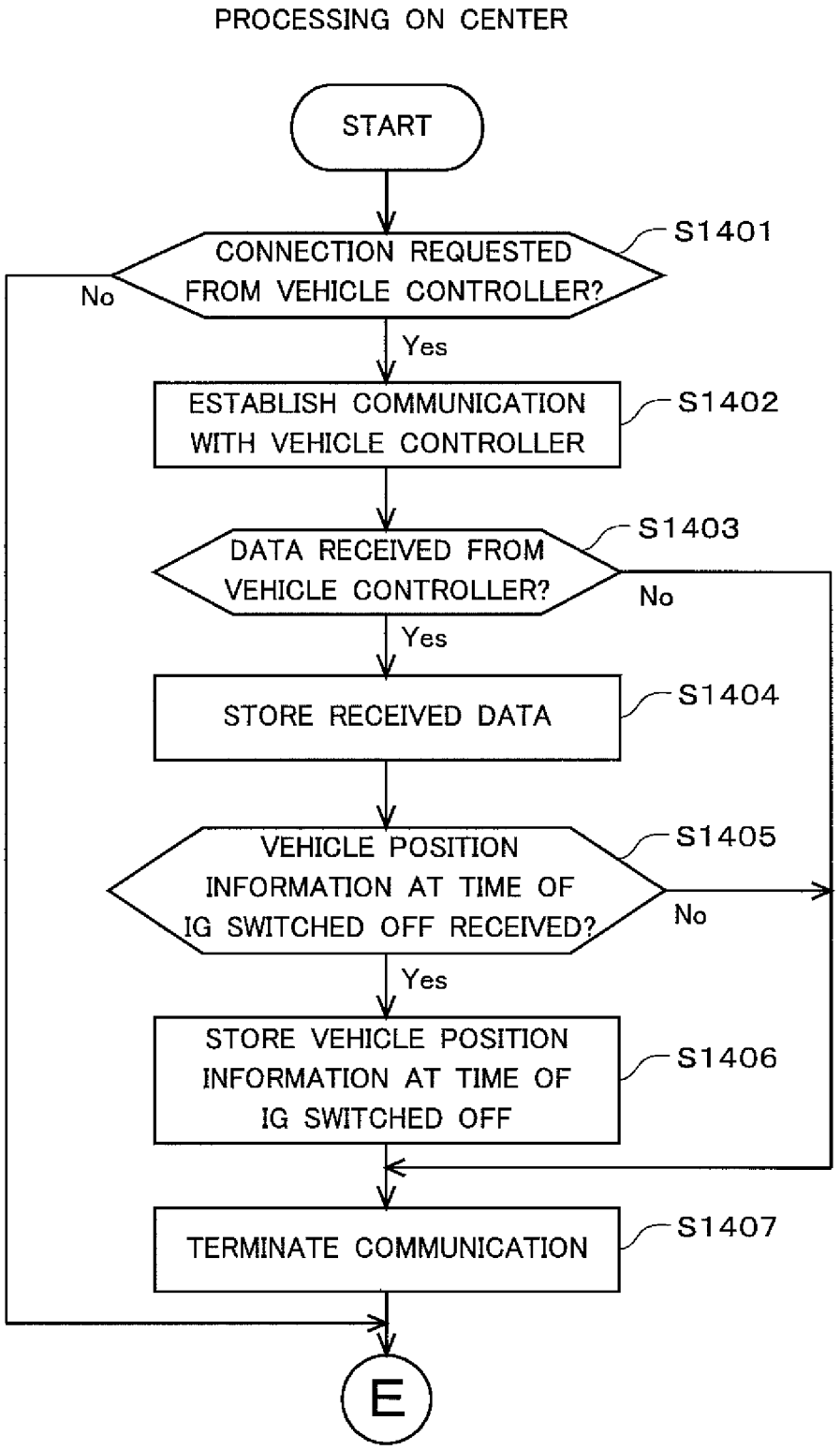
FIG. 14 shows a flowchart of the processing on the center.

After executing the procedure of the steps (from the step S1401 to the step S1407) shown in FIG. 14 and the procedure of the steps (from the step S1501 to the step S1504) shown in FIG. 15, the center 30 judges whether the received data include the command of the request for starting (step S2201). The step for judgment can be executed in the same manner as the step S1505. When it is judged that the received data include the command of the request for starting (Yes at the step S2201), a controller 31 judges whether the vehicle position information has been obtained (step S2202). When the controller 31 judges that the received data do not include the command of the request for starting (No at the step S2201), or when the controller 31 judges that the vehicle position information has not been obtained (No at the step S2202), the procedure moves to the next step without execution of the processing on the controller 31 regarding the request for starting.

As above, when the authentication flag is not set, the vehicle controller 10 does not transmit the vehicle position information based on the judgment where the vehicle controller 10 does not belong to the proper user. Therefore, the center 30 can judge that the vehicle controller 10 does not belong to the proper user, based on the fact that the center 30 has not obtained the vehicle position information. That is, when the center 30 has not obtained the vehicle position information, the center 30 prohibits the processing for starting based on the judgment that the vehicle controller 10 does not belong to the proper user, even if the center 30 receives the request for starting from the mobile terminal 20.

When judging that the vehicle position information has been obtained (Yes at the step S2202), the controller 31 executes the step for transmitting the request for starting (step S2203), and the step for transmitting the execution information on the processing for starting (step S2204). Each of these steps can be executed in the same manner as the step S1506 and the step S1507.

Next, the center 30 judges whether the received data include the command of the request for door lock control (step S2205). The step for judgment can be executed in the same manner as the step S1601. When it is judged that the received data include the command of the request for door lock control (Yes at the step S2205), the controller 31 judges whether the vehicle position information has been obtained (step S2206).

The step S2206 is executed in the same manner as the step S2202 described above. That is, when the controller 31 judges that the vehicle position information has not been obtained (No at the step S2202), the procedure moves to the next step (step S1606) without execution of the processing on the controller 31 regarding the request for door lock control. When judging that the vehicle position information has been obtained (Yes at the step S2206), the controller 31 executes the step regarding the door lock (step S2207), and the step for transmitting the execution information on the processing for door lock (step S2208). Each of these steps can be executed in the same manner as the steps from the step S1602 to the step S1605. Then, the procedure moves to the step S1606 shown in FIG. 16. As above, when the vehicle controller 10 does not belong to the proper user, the center 30 also prohibits the processing regarding the door lock.

In the third embodiment, the center 30 judges whether the vehicle position information has been obtained when receiving the command of the request for starting or receiving the command of the request for door lock control. However, the center 30 may judge whether the vehicle position information has been obtained when receiving the command of the request for communication connection from the mobile terminal 20. In this case, it is possible to prohibit the following procedure when the vehicle controller does not belong to the proper user, without execution of judgment such as on whether any data have been received from the mobile terminal 20, and what the received data are, if any.

<4. Fourth Embodiment>

Next, the fourth embodiment is described. In the first embodiment and in the second embodiment described above, when detecting that the IG switch has been switched off from the on-state or switched on from the off-state, the vehicle controller 10 executes the processing for transmitting the vehicle position information to the center 30. However, in most cases, a vehicle control system 100 of the invention or the like becomes available after conclusion of a contract between a service provider and a user. It is undesirable that the vehicle controller 10 automatically transmit the vehicle position information even after cancellation of the contract.

Therefore, in the configuration of the fourth embodiment, the processing for transmitting the vehicle position information is changed in accordance with the status of the contract with the user for the service. Described hereafter are mainly the different points from each of the embodiments described above.

<4-1. Outline of System>

A vehicle control system 100 of the fourth embodiment has the same configuration as the vehicle control system 100 shown in FIG. 1. However, a vehicle controller 10 and a center 30 of the fourth embodiment store a flag indicating the status of the contract (hereinafter, referred to as "contract flag") respectively in a first memory 14 and in a memory 33. In the fourth embodiment, the processing on the vehicle controller 10 and the processing on the center 30 are partially different from each of the embodiments described above. The configuration of and the processing on a mobile terminal 20 are the same as each of the embodiments described above. Therefore, described hereinafter are mainly the different points from each of the first embodiment and the second embodiment, regarding the processing on the vehicle controller 10 and the processing on the center 30.

<4-2. Processing on Center>

Figure 23:
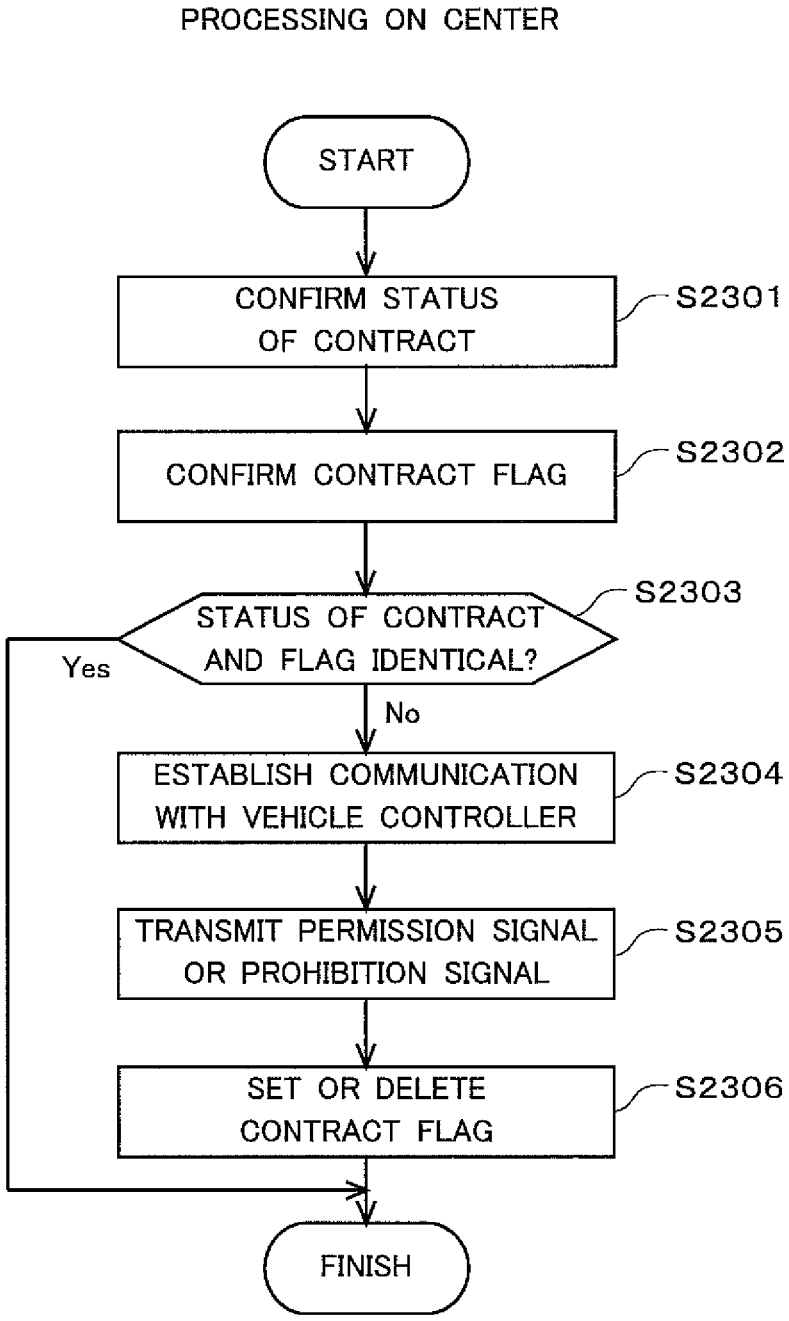
FIG. 23 shows another flowchart of the processing on the center.

The center 30 monitors the status of the contract, and transmits to the vehicle controller 10 the information on whether to transmit the vehicle position information based on the status of the contract. Thus, described first is the processing on the center 30 for transmitting the information on whether to transmit the vehicle position information based on the status of the contract. FIG. 23 shows a flowchart of the processing on the center 30.

The center 30 confirms the status of the contract with the user periodically or when receiving the request for communication connection from the vehicle controller 10 or a mobile terminal 20 (step S2301). The information, "under contract" or "contract cancelled," on the status of the contract is stored, for example, in the database sorted for each user. Next, the center 30 confirms the contract flag (step S2302). In the fourth embodiment, when the contract is concluded, that is "under contract," the center 30 sets the contract flag. When the contract is cancelled, that is "contract cancelled," the center 30 deletes the contract flag. In the configuration of the fourth embodiment, the center 30 does not change the contract flag while the status of the contract is not changed. That is, the center 30 confirms whether the contract flag is set, as well as confirming the information on the contract.

After confirming the status of the contract and the contract flag, the center 30 judges whether the contents of the status of the contract and the contract flag are matched (step S2303). That is, the center 30 judges that the status of the contract and the contract flag are matched when judging that the status indicates "under contract," and when the contract flag is set. The judgment in the case of "contract cancelled" is made in the same manner. When judging that the contents of the status of the contract and the contract flag are matched (Yes at the step S2303), the center 30 judges that the status of the contract is not changed, and the procedure is finished.

When judging that the contents of the status of the contract and the contract flag are not matched (No at the step S2303), the center 30 executes the processing for transmitting to the vehicle controller 10 the information on whether to transmit the vehicle position information. First, the center 30 establishes the communication with the vehicle controller 10 (step S2304). The step can be executed in the same manner as each of the embodiments described above. Then, the center 30 transmits to the vehicle controller 10 the signal indicating permission or the signal indicating prohibition on transmission of the vehicle position information (step S2305).

Here is an example where the contents are not matched; although the center 30 has confirmed that the status indicates "under contract," the contract flag is not set. Concretely, since it is judged that a new contract has been concluded, the center 30 transmits to the vehicle controller 10 the permission signal to permit transmission of the vehicle position information. Then, the center 30 sets the contract flag in the memory 33 (step S2306). Here is another example where the contents are not matched; although the center 30 has confirmed that the status indicates "contract cancelled," the contract flag is set. Concretely, since it is judged that the contract has been newly cancelled, the center 30 transmits to the vehicle controller 10 the prohibition signal to prohibit transmission of the vehicle position information. Then, the center 30 deletes the contract flag in the memory 33 (step S2306).

In the case where the contract flag is not set, the center 30 does not execute any of the processing even when receiving the direction for controlling the vehicle from a distance from the mobile terminal 20. In the case where the contract flag is set, the center 30 executes the processing shown in FIG. 14 and the following figures when receiving the direction for controlling the vehicle from a distance from the mobile terminal 20.

<4-3. Processing on Vehicle Controller>

Next, the processing on the vehicle controller 10 is described. When receiving the permission signal or the prohibition signal for transmitting the vehicle position information from the center 30, the vehicle controller 10 judges the status of the contract based on the received signal, and controls whether to execute the processing for starting or the processing for transmitting the vehicle position information. Hereafter, the processing on the vehicle controller 10 is described.

Figure 24:
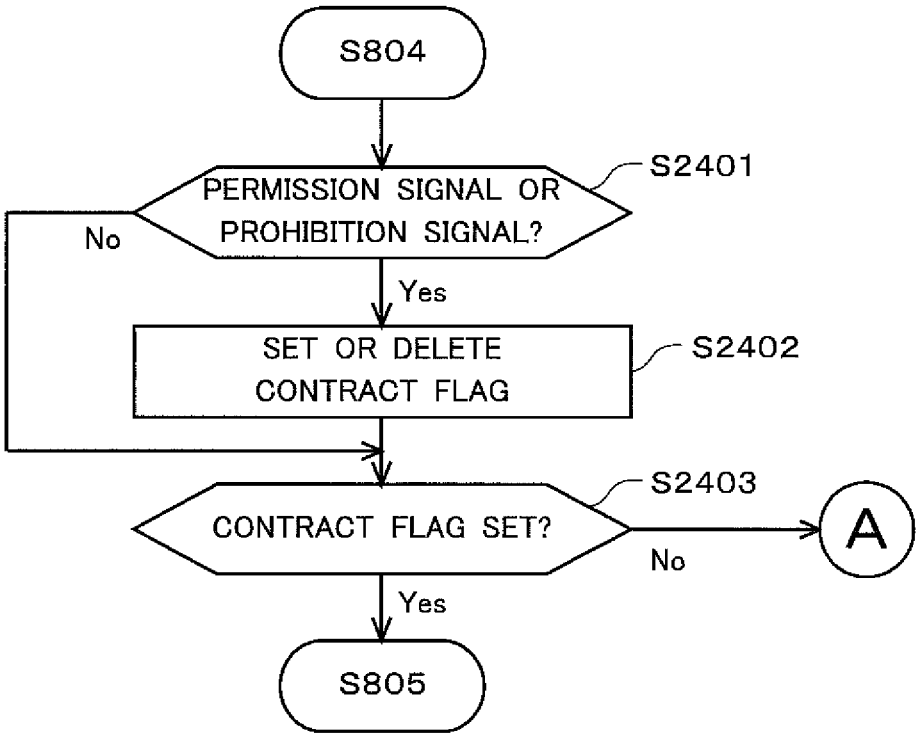
FIG. 24 shows another flowchart of the processing on the vehicle controller.

FIG. 24 shows, a flowchart of the processing on the vehicle controller 10 for setting the contract flag. The vehicle controller 10 executes the procedure from the step for receiving the request for communication connection from the center 30 to the step for storing data in the same manner as the steps from the step S801 to the step S804. After storing the data, the vehicle controller 10 judges whether the data received from the center 30 correspond to either of the permission signal and the prohibition signal for transmitting the vehicle position information (step S2401).

When judging that the received data correspond to either the permission signal or the prohibition signal (Yes at the step S2401), the vehicle controller 10 sets or deletes the contract flag in the first memory 14 in accordance with the signal type (step S2402). That is, the vehicle controller 10 sets the contract flag when the received data correspond to the permission signal, and deletes the contract flag when the received data correspond to the prohibition signal.

When judging that the received data correspond to neither the permission signal nor the prohibition signal (No at the step S2401), the vehicle controller 10 judges whether the contract flag is set in the first memory 14 (step S2403). When the contract flag is set (Yes at the step S2403), the vehicle controller 10 continues the processing such as for starting (step S805 and the following steps). When the contract flag is not set, the procedure is finished without execution of the processing on the vehicle controller 10 such as for starting (A in FIG. 24).

Figure 25:
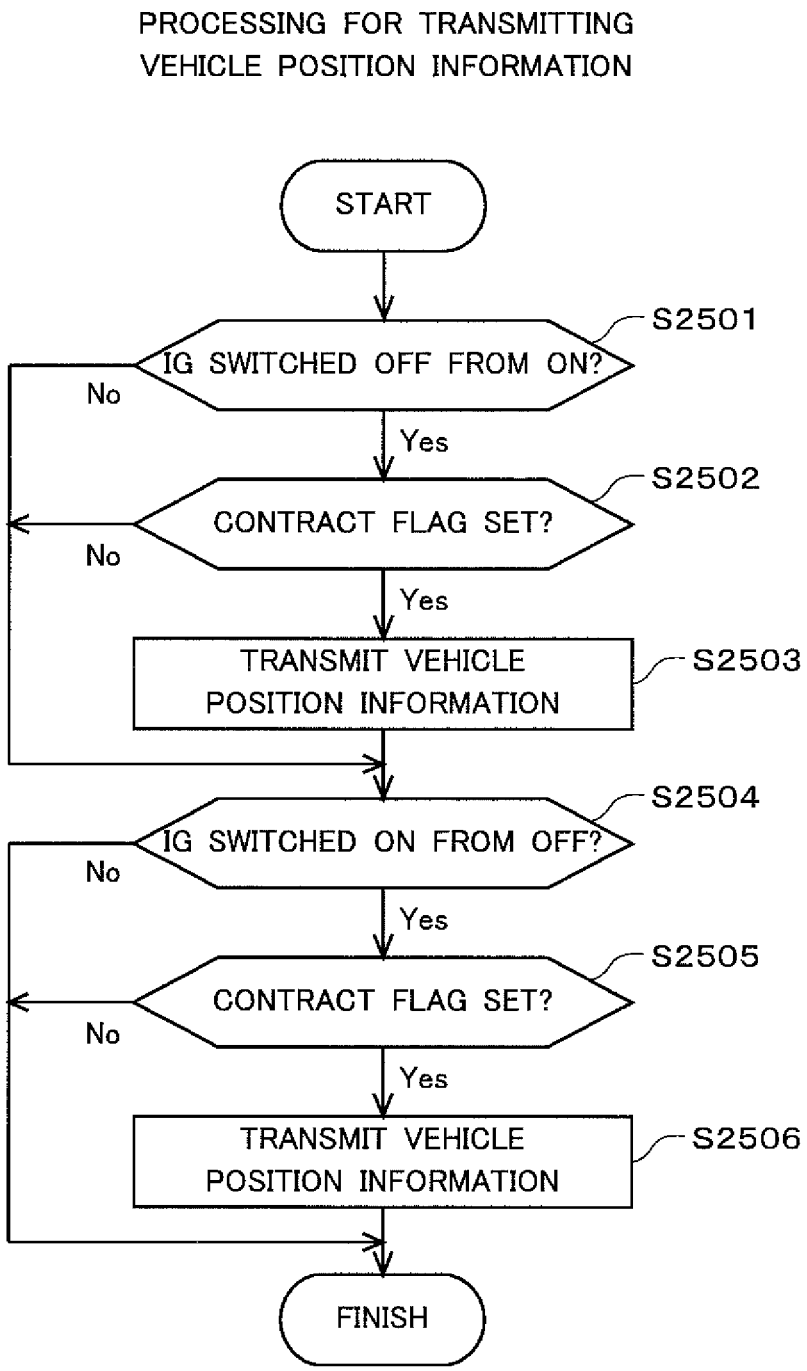
FIG. 25 shows another flowchart of the processing on the vehicle controller.

Described next is the processing on the vehicle controller 10 for controlling whether to transmit the vehicle position information based on the status of the contract. FIG. 25 shows a flowchart of the processing on the vehicle controller 10 for transmitting the vehicle position information.

First, a vehicle information obtaining part 11*a* detects whether an ignition switch has been manually switched off from an on-state (step S2501). The step can be executed in the same manner as the step S701 described above. When the vehicle information obtaining part 11*a* detects that the ignition switch has been switched off from the on-state (Yes at the step S2501), the vehicle controller 10 judges whether the contract flag is set in the first memory 14 (step S2502). When the contract flag is set (Yes at the step S2502), the vehicle controller 10 executes the processing for transmitting the vehicle position information (step S2503). The step can be executed in the same manner as the steps from the step S702 to the step S705 described above.

When the vehicle information obtaining part 11*a* does not detect that the ignition switch has been switched off from the on-state (No at the step S2501), or when the contract flag is not set in the first memory 14 (No at the step S2502), the procedure moves to the next step without execution of the processing for transmitting the vehicle position information.

Next, the vehicle information obtaining part 11*a* detects whether the ignition switch has been manually switched on from the off state (step S2504). The step can be executed also in the same manner as the step S706 described above. When the vehicle information obtaining part 11*a* detects that the ignition switch has been switched on from the off-state (Yes at the step S2504), the vehicle controller 10 judges whether the contract flag is set in the first memory 14 (step S2505). When the contract flag is set (Yes at the step S2505), the vehicle controller 10 executes the processing for transmitting the vehicle position information (step S2506). The step can be executed also in the same manner as the steps from the step S707 to the step S710 described above.

When the vehicle information obtaining part 11*a* does not detect that the ignition switch has been switched on from the off-state (No at the step S2504), or when the contract flag is not set in the first memory 14 (No at the step S2506), the procedure is finished without execution of the step for transmitting the vehicle position information.

As above, since the vehicle controller 10 judges whether to transmit the vehicle position information based on the status of the contract, the vehicle controller 10 prevents the case where the vehicle position information is automatically transmitted in spite of the state where the contract is cancelled.

Further, in each of the embodiments described above, various functions are executed by software, specifically by CPU processing based on programs. However, some of these functions may be executed by electrical hardware circuits. Contrarily, some of the functions executed through hardware circuits in the above descriptions may be executed through software.

In the invention, by storing the authentication result in advance, the vehicle controller is capable of controlling the door lock and the door unlock without conducting the verification again at the time when the request for door lock control is received.

Moreover, in the invention, by conducting the verification such as when the authentication codes have never been verified or when the authentication result is deleted, the vehicle controller is capable of obtaining the updated authentication result. In an example, when the stored authentication result is deleted because the vehicle controller has been replaced with another one, the vehicle controller is capable of judging whether the vehicle controller belongs to the proper user by conducting the verification again.

Moreover, in the invention, the vehicle controller is capable of preventing the case where the driving apparatus is started wrongly in spite of the verification for controlling the door lock and the door unlock.

While the invention has been shown and described in detail, the foregoing description is in all aspects illustrative and not restrictive. It is therefore understood that numerous other modifications and variations can be devised without departing from the scope of the invention.

What is claimed is:

1. A vehicle controller that is installed in a vehicle and that controls one or more operations of the vehicle, the vehicle controller comprising a control unit that:

(i) outputs a first code for authentication to a judging apparatus within the vehicle, which judges whether to permit starting of a driving apparatus of the vehicle, when a request for starting the driving apparatus is obtained from an information processor which is located outside the vehicle, the first code being stored in the vehicle controller and not being transmitted from the information processor;

(ii) controls locking and unlocking of doors of the vehicle when a request for door lock control is obtained from the information processor; and (iii) obtains from the judging apparatus an authentication result of whether the first code and a second code for authentication which the judging apparatus uses are identical, wherein when obtaining the request for door lock control from the information processor, the control unit controls the locking and unlocking of the doors based on the authentication result obtained from the judging apparatus within the vehicle, when detecting that an ignition switch of the vehicle has been switched from an off-state to an on-state, or has been switched from the on-state to the off-state, the vehicle controller executes processing for transmitting a vehicle position information to the information processor, and the processing for transmitting the vehicle position information to the information processor is changed in accordance with a status of a contract with a user for a service.

2. The vehicle controller of claim 1, wherein when the authentication result indicates that the first code and the second code are not identical, the control unit prohibits execution of the request for door lock control.

3. The vehicle controller of claim 1, further comprising:

a memory that stores the authentication result.

4. A vehicle control system that controls a vehicle, the vehicle control system comprising:

a vehicle controller that is installed in the vehicle, the vehicle controller including a control unit that:

(i) outputs a first code for authentication when a request for starting a driving apparatus of the vehicle is obtained from an information processor which is located outside the vehicle, the first code being stored in the vehicle controller and not being transmitted from the information processor; and (ii) controls locking and unlocking of doors of the vehicle when a request for door lock control is obtained from the information processor; and a judging apparatus that is installed in the vehicle and that receives the first code for authentication from the control unit and judges whether to permit starting of the driving apparatus of the vehicle, the judging apparatus using a second code for authentication to determine an authentication result of whether the first code and the second code are identical, wherein when obtaining the request for door lock control from the information processor, the control unit controls the locking and unlocking of the doors based on the authentication result obtained from the judging apparatus, when detecting that an ignition switch of the vehicle has been switched from an off-state to an on-state, or has been switched from the on-state to the off-state, the vehicle controller executes processing for transmitting a vehicle position information to the information processor, and the processing for transmitting the vehicle position information to the information processor is changed in accordance with a status of a contract with a user for a service.

5. The vehicle control system of claim 4, wherein when the authentication result indicates that the first code and the second code are not identical, the control unit prohibits execution of the request for the door lock control.

6. The vehicle control system of claim 4, wherein the vehicle controller further comprises a memory that stores the authentication result.

7. The vehicle control system of claim 6, wherein when the authentication result is not stored in the memory when the request for door lock control is obtained, the judging apparatus verifies the first code and the second code.

8. The vehicle control system of claim 7, wherein when the authentication result is not stored in the memory when the request for door lock control is obtained, the judging apparatus does not permit the starting of the driving apparatus even when the first code and the second code are identical at the time when the request for door lock control is obtained until the judging apparatus subsequently judges to permit starting of the vehicle by determining that the first code and the second code are identical.

* * * * *